US011530060B2

(12) United States Patent
Stadler et al.

(10) Patent No.: US 11,530,060 B2
(45) Date of Patent: Dec. 20, 2022

(54) HANDLING APPARATUS AND/OR PACKAGING APPARATUS AND METHOD USED TO PACKAGE ARTICLE GROUPS IN OUTER PACKAGING

(71) Applicant: Krones Aktiengesellschaft, Neutraubling (DE)

(72) Inventors: Thomas Stadler, Kolbermoor (DE); Markus Gabler, Rohrdorf-Thansau (DE)

(73) Assignee: KRONES Aktiengesellschaft, Neutraubling (DE)

( * ) Notice: Subject to any disclaimer, the term of this patent is extended or adjusted under 35 U.S.C. 154(b) by 201 days.

(21) Appl. No.: 16/705,490

(22) Filed: Dec. 6, 2019

(65) Prior Publication Data

US 2020/0189776 A1 Jun. 18, 2020

(30) Foreign Application Priority Data

Dec. 14, 2018 (DE) ..... 10 2018 132 329.8

(51) Int. Cl.
*B65B 21/18* (2006.01)
*B65B 35/36* (2006.01)
(Continued)

(52) U.S. Cl.
CPC ..... *B65B 21/18* (2013.01); *B65B 5/06* (2013.01); *B65B 35/36* (2013.01); *B65B 43/52* (2013.01)

(58) Field of Classification Search
CPC ..... B65B 21/18; B65B 5/06; B65B 35/36; B65B 43/52
See application file for complete search history.

(56) References Cited

U.S. PATENT DOCUMENTS 1,330,524 A * 2/1920 Freud ..... B65B 21/18 53/493
2,277,688 A * 3/1942 Cattonar ..... B65B 21/18 53/534

(Continued)

FOREIGN PATENT DOCUMENTS

DE 202014101173 U1 6/2015
GB 836632 A 6/1960

(Continued)

OTHER PUBLICATIONS

Priority Application: DE 10 2018 132 329.8 filed on Dec. 14, 2018—German Search Report dated Aug. 13, 2019.

(Continued)

*Primary Examiner* — Nathaniel C Chukwurah
*Assistant Examiner* — Lucas E. A. Palmer
(74) *Attorney, Agent, or Firm* — Simmons Perrine Moyer Bergman PLC

(57) ABSTRACT

The invention includes a method used to place article groups into outer packagings (22) packaging apparatus (10). Article groups are transferred by a handling device (26) from a staging location (46) to a conveyor line (20) and are placed into the outer packagings (22). The conveyor line (20) serves to successively transport outer packagings (22). At least some of the articles (14) of a particular article group are directed and/or guided during a placing procedure by a centering device (32) assigned to the conveyor line (20) and moved along with the outer packagings (22), which are being transported on the conveyor line (20) and which are to be loaded with article groups.

15 Claims, 16 Drawing Sheets

(51) Int. Cl.
*B65B 43/52* (2006.01)
*B65B 5/06* (2006.01)

(56) References Cited

U.S. PATENT DOCUMENTS 2,890,553 A * 6/1959 Day ..... B65B 39/006 53/497
3,327,450 A * 6/1967 Carter ..... B65B 21/18 53/496
3,335,542 A * 8/1967 Luxemborg ..... B65B 43/58 53/247
3,505,787 A * 4/1970 Tiews ..... B65B 21/18 53/539
3,553,932 A * 1/1971 Rowekamp ..... B65B 21/18 53/539
3,555,770 A * 1/1971 Rowekamp ..... B65B 21/18 53/495
3,555,773 A * 1/1971 Rowekamp ..... B65B 21/20 53/539
3,601,951 A * 8/1971 Bargel ..... B65B 21/18 53/497
3,884,014 A * 5/1975 Ishida ..... B65B 5/101 53/55
4,055,943 A * 11/1977 Reichert ..... B65B 21/183 53/247
4,215,521 A * 8/1980 Hartness ..... B65B 21/16 53/248
6,571,532 B1 * 6/2003 Wiernicki ..... B65B 21/183 414/225.01
6,729,103 B1 * 5/2004 Hartness ..... B65B 21/183 53/247
6,748,725 B2 * 6/2004 Hartness ..... B65B 21/183 53/247
6,883,296 B2 * 4/2005 Hartness ..... B65B 21/183 53/247
7,552,570 B2 * 6/2009 Raudat ..... B65B 21/06 53/235
11,198,528 B2 * 12/2021 Prinz ..... B65B 21/18
2004/0003574 A1 * 1/2004 Hartness ..... B65B 21/183 53/247
2004/0068956 A1 * 4/2004 Hartness ..... B65B 21/183 53/247
2014/0059976 A1 * 3/2014 Raudat ..... B65B 5/06 53/244
2016/0347488 A1 * 12/2016 Ford ..... B65B 65/003
2019/0185190 A1 * 6/2019 Fechter ..... B65B 43/42
2019/0248522 A1 * 8/2019 Prinz ..... B65B 61/207

FOREIGN PATENT DOCUMENTS

WO 9632323 A2 10/1996
WO WO-2015136118 A2 * 9/2015 ..... B65B 21/18

OTHER PUBLICATIONS

Priority Application: DE 10 2018 132 329.8, Filed Dec. 14, 2018—Extended European Search Report dated Jul. 1, 2020.

* cited by examiner

HANDLING APPARATUS AND/OR PACKAGING APPARATUS AND METHOD USED TO PACKAGE ARTICLE GROUPS IN OUTER PACKAGING

CLAIM OF PRIORITY

The present application claims priority to German Application DE 10 2018 132 329.8, filed Dec. 14, 2018, which are incorporated by reference.

FIELD OF THE INVENTION

The present invention relates to a handling apparatus and/or packaging apparatus used to package article groups in outer packaging and/or to place article groups into outer packagings, the apparatus having the features of the independent claim 1. The invention moreover relates to a method used to package article groups in outer packaging and/or to place article groups into outer packagings, the method having the features of the independent method claim.

BACKGROUND OF THE INVENTION

The automated loading of article groups, such as beverage containers, into outer packagings, such as beverage crates or beverage boxes, is normally carried out discontinuously because the outer packagings or beverage crates, which in such instances are typically transported in an uninterrupted product stream by conveyor belts or other horizontal conveying devices, need to be stopped for each loading procedure even if they are transported at continuous conveying speed in the remaining course of the process. For a precise loading, packaging machines equipped for the automated loading of article groups into outer packagings usually require the outer packaging to stand still, at least during the actual procedure of placing the article group into the outer packaging. Such a discontinuous loading naturally has the disadvantage of a comparatively low capacity, because the conveyance of the outer packagings or crates has to be repeatedly stopped in order to place the articles or containers into the outer packagings with the desired precision.

There are various approaches in prior art to reduce the recognized disadvantages, for example, by a quasi-continuous conveyance of outer packagings while being loaded with articles, such as described in WO 96/32323 or in GB 836 632.

If it can be achieved to load articles into the outer packagings in the ongoing conveying process, another requirement to be observed in such loading procedures becomes more and more important. The higher the conveying speed is at which the outer packagings are being moved while being loaded with articles, the higher the achievable product throughput will be, because the articles will have to be placed into the outer packagings at correspondingly shorter intervals. However, the articles have to be positioned very precisely in order not to miss their target positions in the outer packagings or in order for them not to collide with the outer packagings before being deposited in their particular target positions. Each such collision carries the risk of interrupting production, thus necessitating an interruption in the ongoing packaging operation.

In view of the disadvantages in the prior art, it can be regarded as a primary object of the invention to provide a simply constructed and reliably operating apparatus used to package articles or, as applicable, to place them into outer packagings, as well as to provide a corresponding packaging method, in which, on the one hand, disturbing discontinuities during the conveyance can be reduced or even prevented, and in which, on the other hand, the risks of misloading the outer packagings or of an imprecise positioning can be significantly reduced.

The above-identified object is achieved by a handling apparatus and/or packaging apparatus as well as by a method used to transfer articles being conveyed, for example, in a mass flow and/or transported in rows or articles located in staging positions in another manner, into outer packagings being moved continuously or intermittently along a conveyor line, the apparatus and the method having the features of the particular independent claims. Further advantageous embodiments of the invention are described in the relevant dependent claims.

In order to achieve the above-mentioned object, the invention, besides the method described further below, also proposes a handling apparatus and/or packaging apparatus used to package article groups in outer packaging and/or to place article groups into outer packagings, which handling apparatus and/or packaging apparatus has a staging location for articles and/or for article groups, which staging location can optionally also be formed by a conveying device used to transport articles in a mass flow or in rows. If a supplying or staging in general or a staging location is referred to in the present context, this therefore does not only conceptually comprise a location where articles are staged in order to be taken over, but rather also in a very general sense a place or a conveying device where articles are transported to in order to be seized and taken over.

SUMMARY OF THE INVENTION

The handling apparatus and/or packaging apparatus according to the invention furthermore comprises at least one conveyor line to successively transport outer packagings provided and prepared for an accommodation of in each instance at least one article group that has been formed from a plurality of articles. It should be pointed out that the packagings generalizingly referred to as outer packagings in the context of the present description can also take the shape of various different receptacles, which generally have to be suited to accommodate the articles, that is, at least one article group or a plurality of articles inserted thereinto together. In practice, the outer packagings can take the shape, for example, of boxes, trays, beverage cases, etc., which are open at the top and into which the articles can be placed from above by the handling device explained further below in detail, in particular, with the at least one controllable gripper head of the handling device. If, moreover, articles are generalizingly referred to, these are intended to be mass-flow-suitable piece goods for which the further handling and/or transport and/or shipment is typically carried out with outer packagings. The articles can thus be formed, in particular, by receptacles, beverage containers, bottles, cans, or the like, which can be gathered together in stackable and/or palletizable packaging units by the outer packagings.

The apparatus moreover comprises at least one handling device that is movable between the staging location and the at least one conveyor line, the handling device being provided and designed to simultaneously receive and seize in each instance one article group from the staging location, to transfer the article group to the conveyor line, and to place the article group into one of the outer packagings, which have been conveyed there. If a handling device is referred to in the present context, which handling device can be equipped with, for example, at least one gripper head used to handle the articles, this can be, for example, a gantry robot, a multi-axis robot, a parallel kinematic robot, or another suitable handling device, which can be moved back and forth between the at least two conveyor lines to transfer a plurality of articles simultaneously to the outer packagings, and which can at the same time in this process be lifted and lowered, as required.

For example, at least one controllable gripper head used to simultaneously receive a plurality of articles, such as beverage containers or bottles, can be located at a movable tool head of this handling device, which gripper head, for example, can be equipped with controllable article grippers, such as suction grippers, or with controllable gripper bells or the like, with which the articles, beverage containers, or bottles, can be seized and securely held for the transfer into the outer packaging and can also be reliably released in order to be deposited in the outer packaging. If the handling device is equipped with only one gripper head, it is normally possible to load an outer packaging with a defined number of articles, beverage containers, or bottles, simultaneously, for example, with a number of articles arranged in a rectangular group of a total of twenty or twenty-four or more articles, beverage containers, or bottles. The gripper head thus has to be equipped with a number of article grippers, which are normally controllable together, corresponding to the number of articles to be gripped, which article grippers can in their spatial arrangement in relation to each other moreover correspond to the arrangement of articles in the article group or can be adaptable to this arrangement.

Optionally, however, the handling device can also be equipped with two or three gripper heads of the same type, which allow to seize a correspondingly larger number of articles simultaneously and to place the articles in two or three consecutively conveyed outer packagings, for example. By the in this way created possibility to load a plurality of outer packagings simultaneously with particular article groups, in particular, with article groups in each instance of the same type, a correspondingly high throughput for loading the articles into the outer packagings is possible.

The present invention has the special innovation of a centering device assigned to the at least one conveyor line and movable along together with the outer packagings being transported there and to be loaded in each instance with article groups, which centering device serves to direct and guide at least some of the articles of a particular article group during a placing procedure, which articles are to be placed into the outer packagings by the handling device, and which centering device can effectively prevent the articles from colliding with the outer packages during the placing procedure or during the loading procedure, which is normally executed in a very short time and at a correspondingly high speed, from being imprecisely placed into the outer packaging, and/or from missing their particular target positions in the outer packaging.

As already indicated above, it can be provided for the apparatus according to the invention that the handling device comprises at least one controllable gripper head for an article group to be to be received and to be to be seized, with gripping elements that are controllable individually, in groups, or together for each article to be received and to be seized. In addition, it can be provided that each outer packaging to be loaded by a gripper head of the handling device in each instance has a separate centering element assigned to it, which centering element is a component of the movable centering device.

In this context it can preferably be provided that largely all positioning movements of the handling device and/or of the at least one gripper head in relation to an outer packaging to be loaded with an article group can be coordinated and/or synchronized with the positioning movements of the at least one centering element of the centering device. In this way, the centering device can be coordinated in its positioning movements to the conveying movements of the outer packagings as well as to the positioning procedures of the handling device at least in the last phase of the positioning of the handling device and/or of the gripper heads, that is, immediately prior to the actual placing procedure, which is associated with the disengagement of the articles from the gripper head or from the handling device. It can thereby be ensured that the centering device is in the right place, at least in the critical phase of the immediate approach of the articles to the outer packaging, in order to guide and direct the articles and in order to in this way prevent collisions and misloading due to an insufficiently precise positioning of the articles in relation to the appropriate outer packaging.

The at least one centering element of the centering device can expediently be formed by a suitable centering frame, the size of which preferably corresponds to a base area of an outer packaging, and which can be positioned above and/or placed on a circumferential edge of an outer packaging, and which guides the articles and in this way prevents, for example, that the articles touch down on the edge of the crate.

A particularly expedient variant of the apparatus according to the invention can provide that the centering frame has a plurality of directing devices to direct the articles while they are being placed into an outer packaging, which directing devices can be formed, in particular, by guide panels or the like leading funnel-shaped into the outer packaging.

A plurality of centering elements, preferably disposed next to each other, can optionally form the centering device. It is expedient for the number of centering elements of a centering device to correspond with the number of gripper heads of the handling device as well as with the number of the outer packagings to be loaded simultaneously.

The centering elements can optionally be adjustable together or separately in vertical direction.

The centering elements can optionally be adjustable together or separately in transport direction or opposite to the transport direction. Where required, the centering elements can also be adjustable together or separately transverse to the transport direction in order to be able to compensate for skew positions of the crates or of the outer packagings, for example.

An expedient embodiment variant of the apparatus can be formed by the centering device with its at least one centering element being guided at a movable robot arm. It is likewise conceivable that the centering device with its at least one centering element is guided at a gantry suspension disposed slidably on a rail along the conveyor line. Where required, the centering elements can also be suspended from pneumatic cylinders and be movable on a rail along the conveyor line.

It can moreover be provided that the centering device with its at least one centering element is controllable in its movements based on the detected movements of the outer packagings and/or based on an evaluation of the sensor signals supplied by at least one optical sensor detecting the outer packagings to be loaded.

In order to achieve the above-mentioned object, the invention, besides the handling apparatus and/or packaging apparatus described in various embodiment variants above and used to package article groups in outer packaging and/or to place article groups into outer packagings, furthermore proposes a method used to used to package article groups in outer packaging and/or to place article groups into outer packagings, in which method articles and/or article groups are transferred by a handling device from a staging location for the articles and/or article groups to at least one conveyor line. This conveyor line is used to successively transport outer packagings provided and prepared for an accommodation of in each instance at least one article group having been formed from a plurality of articles. The handling device transfers the articles and/or article groups from the staging location into the outer packagings being located and/or moved on the conveyor line and places the articles and/or article groups thereinto. The method provides that at least some of the articles of a particular article group that have been placed into the outer packagings by the handling device are directed and/or guided during a placing procedure by a centering device assigned to the at least one conveyor line and moved along with the outer packagings, which are being transported there and which are in each instance to be loaded with article groups.

This directing and guiding of the individual articles essentially serves to prevent risks of collisions while placing the articles into the outer packagings, because the relatively high processing speeds and the frequently very close spacings of the articles in the outer packagings increase the danger of the articles touching down with their base surfaces on the edges of the outer packaging or their partitions, thus potentially leading to production interruptions if the placing procedure is thereby disrupted or has to be stopped. The centering device is intended to remedy these problems by being brought to the particular outer packaging in each placing procedure and being positioned there such that the centering device can function as a sort of insertion aid or insertion funnel for the articles.

It can optionally be provided for the method that each outer packaging to be loaded by a gripper head of the handling device in each instance has a separate centering element assigned to it, at least during the actual procedure of placing the articles into the outer packaging in the intended positions, which centering element is a part of the movable centering device.

In this instance it can moreover be expedient to coordinate and/or synchronize largely all positioning movements of the at least one gripper head in relation to an outer packaging to be loaded with an article group with the corresponding positioning movements of the at least one centering element of the centering device such that a centering element is ready to prevent collisions of the articles with the outer packaging each time the articles are inserted into the outer packaging.

The at least one centering element of the centering device can, in particular, be formed by a centering frame, the size of which corresponds to a base area of an outer packaging, and which can be positioned above and/or placed on a circumferential edge of an outer packaging, and which guides the articles. The articles can thereby be prevented very effectively from touching down on the edge of the crate, which can all in all significantly reduce the susceptibility to errors in the packaging method according to the invention.

In order for the centering frame to effectively fulfill its task of improving the method according to the invention, the centering frame can, for example, have a plurality of directing devices to direct the articles while they are being placed into an outer packaging, which directing devices can be formed, in particular, by guide panels or the like leading funnel-shaped into the outer packaging.

A plurality of centering elements, preferably disposed next to each other, can optionally form the centering device.

The method can also provide that the centering elements can be adjusted together or separately in vertical direction in order to be positioned on or above the outer packagings. This adjustment is generally necessary because it is expedient to lower the centering elements at least by a short distance into the particular outer packagings so that their particular guide panels or the like can reach beyond the edge of the outer packaging and down to the top edges of a partition, where appropriate.

It can be moreover provided for the method that the centering elements are adjusted together or separately in transport direction or opposite to the transport direction in order to be positioned on or above the outer packagings. The centering elements can likewise be movable opposite to the transport direction, too, in order to be returned to further outer packagings to be loaded. This movement component of the centering elements is necessary in all loading methods where the outer packagings are moved on the conveyor line and are not brought to a halt while being loaded with articles. The centering elements thus have to be moved along synchronously with the advancing outer packagings in order to be able to reliably fulfill their task during the loading procedure.

In a further variant of the method according to the invention, it can be additionally expedient that the centering elements can be adjusted together or separately transverse to the transport direction for the positioning on or above the outer packagings in order to be able to compensate for skew positions of the crates, for example, or in order to be able to compensate for misalignments of the outer packagings in relation to the transport direction. Since the gripper heads of the handling device are normally also positioned very precisely above the outer packagings, even if these are not precisely in alignment with preceding or following outer packagings or crates, it is in the same way expedient to also have the centering elements perform such compensatory movements. Where appropriate, the outer packagings can be brought into a desired alignment with preceding or following outer packagings or crates, if so desired, by corrective movements of the centering elements transverse to the transport direction.

An expedient variant to perform the method according to the invention can consist in suspending the centering device with its at least one centering element from a movable robot arm, for example, and in guiding it thereat.

It is likewise conceivable to suspend the centering device with its at least one centering element from a gantry suspension and to guide it thereat, which gantry suspension can be slid, for example, on a rail suited for this purpose along the conveyor line. In this instance, the centering elements can be suspended from or guided at pneumatic cylinders, for example, and can be movable on a rail along the conveyor line.

A further expedient option of the method according to the invention can consist in controlling the centering device with its at least one centering element in its movements based on the detected movements of the outer packagings and/or based on an evaluation of the sensor signals supplied by at least one optical sensor detecting the outer packagings to be loaded.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention.

Figure 1:
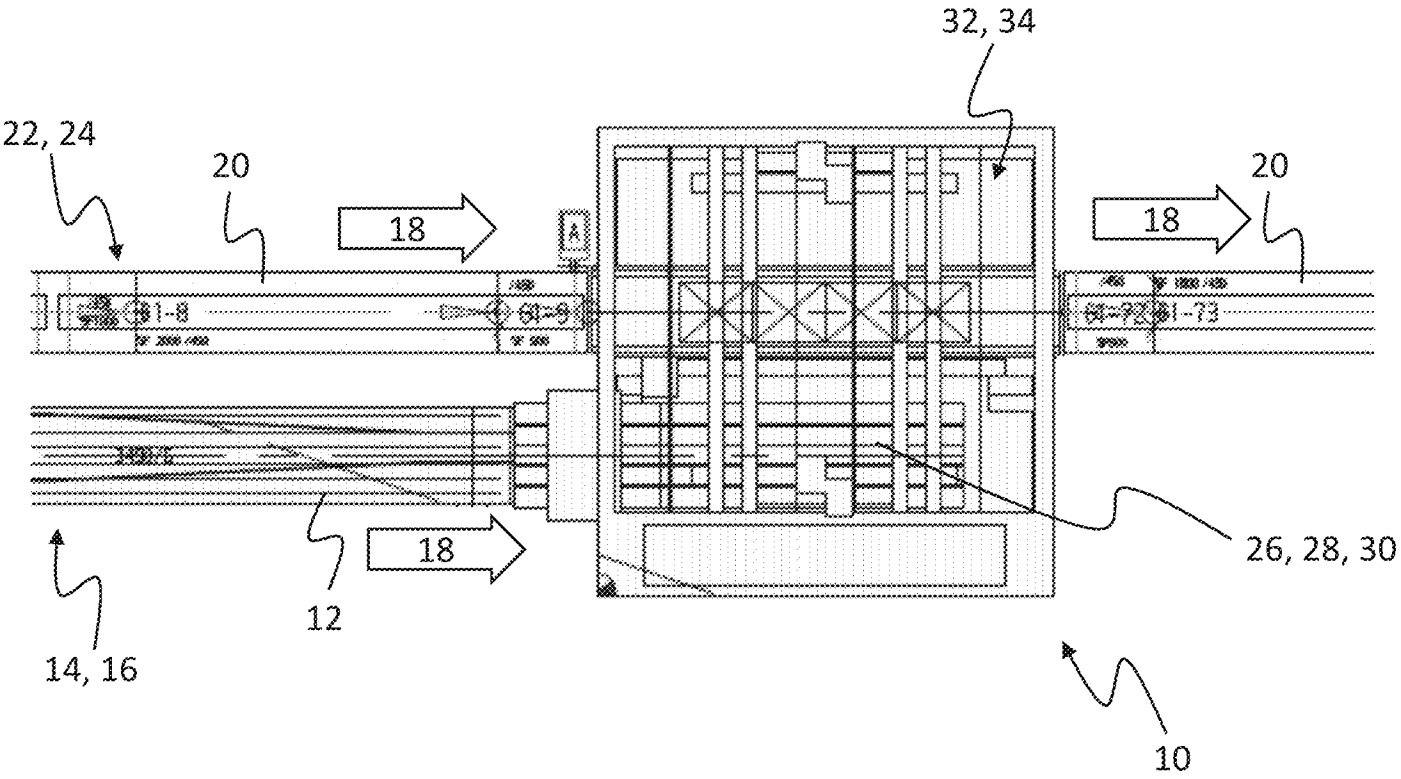
FIG. 1 shows the basic structure of an embodiment variant of a handling apparatus and/or packaging apparatus according to the invention in a schematic top view.

The same or equivalent elements of the invention are designated using identical reference characters. Furthermore and for the sake of clarity, only the reference characters relevant for describing the individual figures are provided. It should be understood that the detailed description and specific examples of the embodiments of the apparatus or of the method according to the invention are intended for purposes of illustration only and are not intended to limit the scope of the invention.

DETAILED DESCRIPTION OF THE INVENTION

The schematic top view of FIG. 1 is intended to primarily illustrate the basic structure of a handling apparatus and/or packaging apparatus 10 according to the invention, which handling apparatus and/or packaging apparatus 10 serves for gathering together article groups and/or packaging article groups in outer packaging, as will be illustrated in the exemplary embodiment described below by the transfer of beverage containers into outer packagings serving as beverage crates. These beverage crates are in each instance suitable and provided to accommodate a defined number of regularly arranged or, as applicable, appropriately grouped beverage containers to be received from the top.

The handling apparatus and/or packaging apparatus 10 only schematically indicated here has a first conveyor line 12 used to transport a multitude of upright articles 14 assigned to it. This first conveyor line 12 can be understood as modification of a staging location for the articles 14 because it is very generally referred to a staging location in the context of the definition of the invention, which can be a stationary delivery location with a multitude of articles 14 staged there or also, for example, a conveyor line 12 according to FIG. 1, with which the articles 14 can be brought into the range of the handling apparatus and/or packaging apparatus 10.

The objects or piece goods generally referred to here as articles 14 are in the present context formed, in particular, by upright beverage containers 16 being transported in a mass flow and/or in rows in a defined conveying direction 18 leading to the apparatus 10. Moreover, a second conveyor line 20 close to the first conveyor line 12 and running parallel thereto in the shown exemplary embodiment is assigned to the apparatus 10, the second conveyor line 20 being used to successively transport outer packagings 22 in the shape of beverage crates 24, which are provided and prepared to accommodate in each instance at least one article group formed from a plurality of articles 14 or beverage containers 16, as applicable.

The outer packagings 22 can generally also be formed by other crates or cases or receptacles of various types, for example, by boxes of simple cardboard or also, for example, by film wrappings, shrink films or other wrappings of planar packaging material. The machine referred to as handling apparatus and/or packaging apparatus 10 in the present context can generally also serve to produce or form bundles such that it is possible to optionally also convey strappings, lengths of film, or the like on the second conveyor line 20 and to supply them to the apparatus 10 for further processing, in order for it to be possible to produce bundles in the apparatus 10 by gathering together grouped articles 14.

As is already discernible from the schematic top view of FIG. 1, the outer packagings 22, which are formed, for example, by the beverage crates 24, are moved to the apparatus 10 on the second conveyor line 20 in the same conveying direction 18 as the articles 14, which are formed, for example, by the beverage containers 16, are moved on the first conveyor line 12. This parallel alignment of the two conveyor lines 12 and 20 with each other is, however, not absolutely necessary, but can rather vary according to requirements in practice such that non-parallel conveying directions 18 of the two conveyor lines 12 and 20 for the articles 14 or beverage containers 16 and for the outer packagings 22 or beverage crates 24, respectively, are optionally also conceivable and handleable.

The handling apparatus and/or packaging apparatus 10 shown in a schematic manner in FIG. 1 furthermore comprises a handling station and/or packaging station 26 that is spatially and functionally assigned likewise to the two conveyor lines 12 and 20. This handling station and/or packaging station 26 serves either to package the articles 14 or beverage containers 16 being conveyed in conveying direction 18 on the first conveyor line 12 by their transfer into the outer packagings 22 or beverage crates 24, which can in each instance accommodate at least one article group or container group formed from a plurality of articles 14 or beverage containers 16. This packaging or transfer of the articles 14 or beverage containers 16 into the outer packagings 22 or into the beverage crates 24 always also comprises a handling process, which is why this section of the apparatus 10 can also be referred to as handling station and/or packaging station 26.

The handling station and/or packaging station 26 can optionally also serve to form bundles by bundling the articles 14 or beverage containers 16 being transported in conveying direction 18 on the first conveyor line 12 by gathering together a plurality of articles 14 or beverage containers 16 into bundles, for example, into strapped bundles, into film bundles, into shrink film bundles, into glued bundles, etc. This gathering together of the articles 14 or beverage containers 16 into bundles likewise always comprises a handling process.

The handling station and/or packaging station 26 has a manipulator 28 or a plurality of manipulators 28, which can be equipped, for example, with at least one gripper head 30 or optionally also with a plurality of parallelly controllable gripper heads 30, which are provided to simultaneously receive and seize from the first conveyor line 12 in each instance one article group with each present gripper head 30, and to transfer it to the second conveyor line 20 within the apparatus 10, and to place the article group, that is, the group of articles 14 or beverage containers 16, into one of the outer packagings 22 or, as applicable, beverage crates 24 being conveyed there. The manipulator 28 formed by at least one gripper head 30 or by a plurality of gripper heads 30 can likewise be provided to seize the articles 14 or beverage containers 16 from the first conveyor line 12 and to supply them for further bundle formation by gathering articles 14 or containers 16 groupwise together in bundles.

Even if a first conveyor line 12 is generally referred to in the present context, it is also possible that instead of such a conveyor line 12, which can be designed as horizontal conveying device, for example, a staging location for the articles 14 or beverage containers 16 designed in nearly any manner is available and used, from which staging location the articles 14 or beverage containers 16 can be seized by the manipulator 28 and can be supplied for bundle formation or placed or inserted into the staged outer packagings 22.

The handling station and/or packaging station 26 only schematically indicated in the FIG. 1 with the manipulator 28 or, as applicable, with the at least one gripper head 30 or with a plurality of approximately synchronously movable and controllable gripper heads 30 can be formed, for example, by a gantry robot, a multi-axis robot, a parallel kinematic robot, or another suitable handling device, of which the manipulator 28, gripper head 30 or gripper heads 30 can be moved back and forth between the staging location not shown here, or between the two conveyor lines 12 and 20, to transfer a plurality of articles 14 or beverage containers 16 simultaneously to the outer packagings 22 or beverage crates 24 staged or optionally being moved in parallel conveying direction 18, and which manipulator 28, gripper head 30 or gripper heads 30 can at the same time in this process be lifted and lowered, as required.

The controllable gripper head 30 or the plurality of gripper heads 30 located at the manipulator 28 being preferably used in the handling station and/or packaging station 26 at a movable tool head (not illustrated in detail here) serves or serve for simultaneously receiving a plurality of articles 14, beverage containers 16, or bottles. For this purpose, the gripper head 30 is or the gripper heads 30 are equipped, for example, with controllable suction grippers or with controllable gripper bells or the like, with which the articles 14, beverage containers 16 or bottles can be seized at their neck section or top section and can be securely held for the transfer and the approximately perpendicular insertion into the outer packagings 22 or beverage crates 24, which are open at the top, and can also be reliably released in order to be deposited in the outer packaging 22 particularly provided for this purpose or into the beverage crate 24 particularly provided for this purpose, as applicable.

If the handling station and/or packaging station 26 is equipped with only one gripper head 30 as manipulator 28 in a simplest equipment variant, it is normally possible to load an outer packaging 22 or, as applicable, a beverage crate 24 with a defined number of articles 14, beverage containers 16, or bottles, simultaneously, for example, with a number of articles arranged in a rectangular group of a total of twenty or twenty-four or more articles, beverage containers 16, or bottles. Preferably, however, the handling station and/or packaging station 26 can also be equipped with two or three gripper heads 30 of the same type, which allow to seize a correspondingly larger number of articles 14 or beverage containers 16 simultaneously and to place the articles 14 or beverage containers 16 into two or three consecutively conveyed outer packagings 22 or beverage crates 24, for example. By the in this way created possibility to load a plurality of outer packagings 22 or beverage crates 24 simultaneously with particular groups of articles 14 or beverage containers 16, a correspondingly high throughput for loading the articles 14 or, as applicable, the containers 16 into the outer packagings 22 is possible.

The schematic illustration of FIG. 1 furthermore shows the second conveyor line 20 leading out of the handling apparatus and/or packaging apparatus 10 in conveying direction 18 to the right or, as applicable, continuing in conveying direction 18, where the conveying direction 18 of the conveyor line 20 remains unchanged for the removal conveyance of the bundles formed in the station 26 or for the removal conveyance of the outer packagings 22 loaded with articles 14 or of the beverage crates 24 loaded with beverage containers 16 for their further handling, such as palletizing. Normally, the section of the second conveyor line 20 leading out of the apparatus 10 to the right can form the continuation of the conveyor line 20 because the beverage crates 24 do not have to be taken down or removed from the second conveyor line 20 while they are being loaded with beverage containers 16.

The reference character 32 in the FIG. 1 refers to a centering device 32 assigned to the second conveyor line 20 and movable along with the outer packagings 22, which are being transported there and which are in each instance to be loaded with article groups, the centering device 32 being used to direct and guide at least some of the articles 14 of a particular article group to be placed into the outer packagings 22 by the handling device 26 or, as applicable, by the manipulator 28 during a placing procedure. In this context, each outer packaging 22 to be loaded by a gripper head 30 of the handling device or of the manipulator 28 can in each instance expediently have a separate centering element 34 assigned to it, which centering element 34 is a component of the movable centering device 32.

Figure 2A:
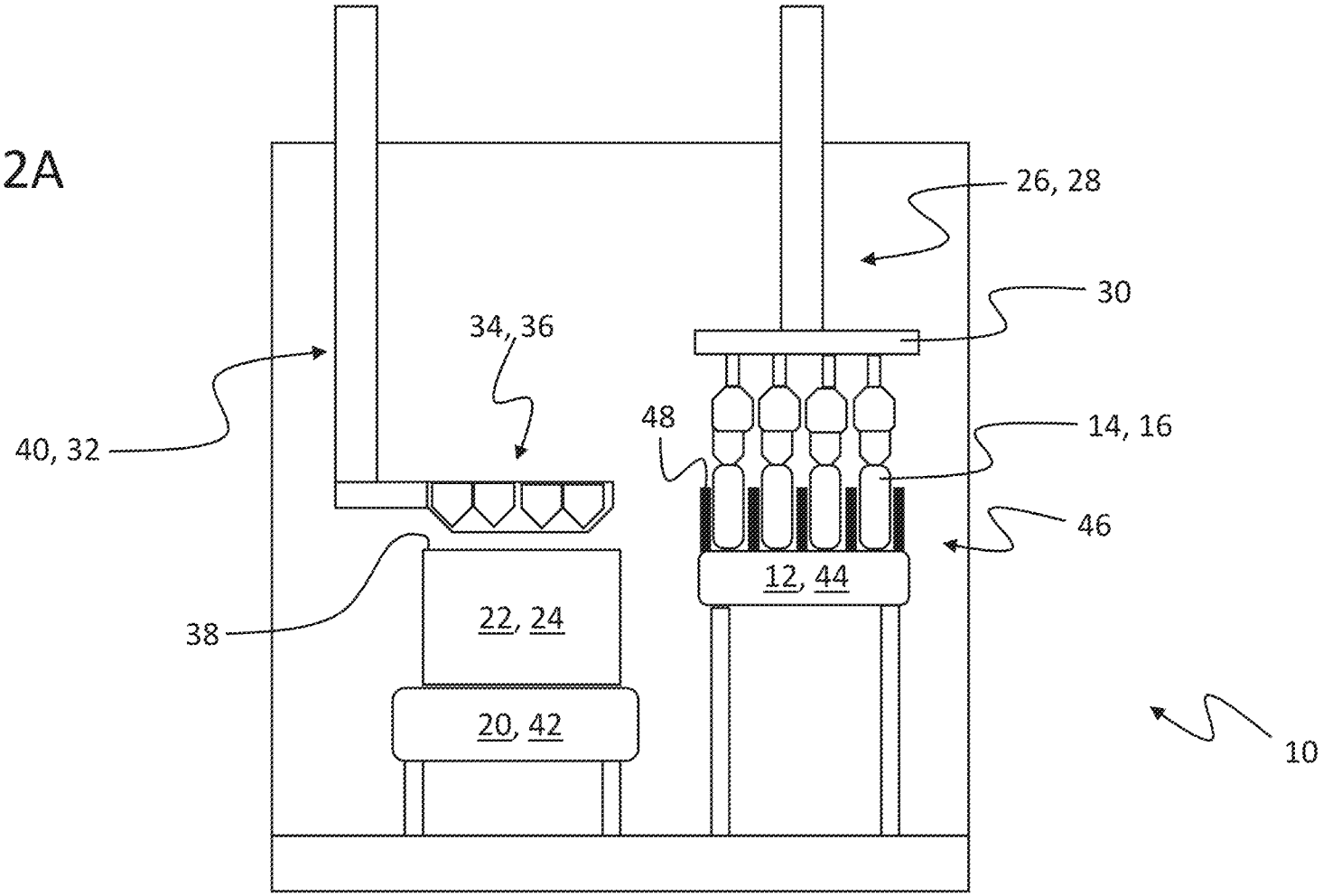
FIG. 2 shows a first variant of a handling apparatus and/or packaging apparatus and its essential components in three schematic views (FIG. 2A, FIG. 2B, and FIG. 2C).
Figure 2B:
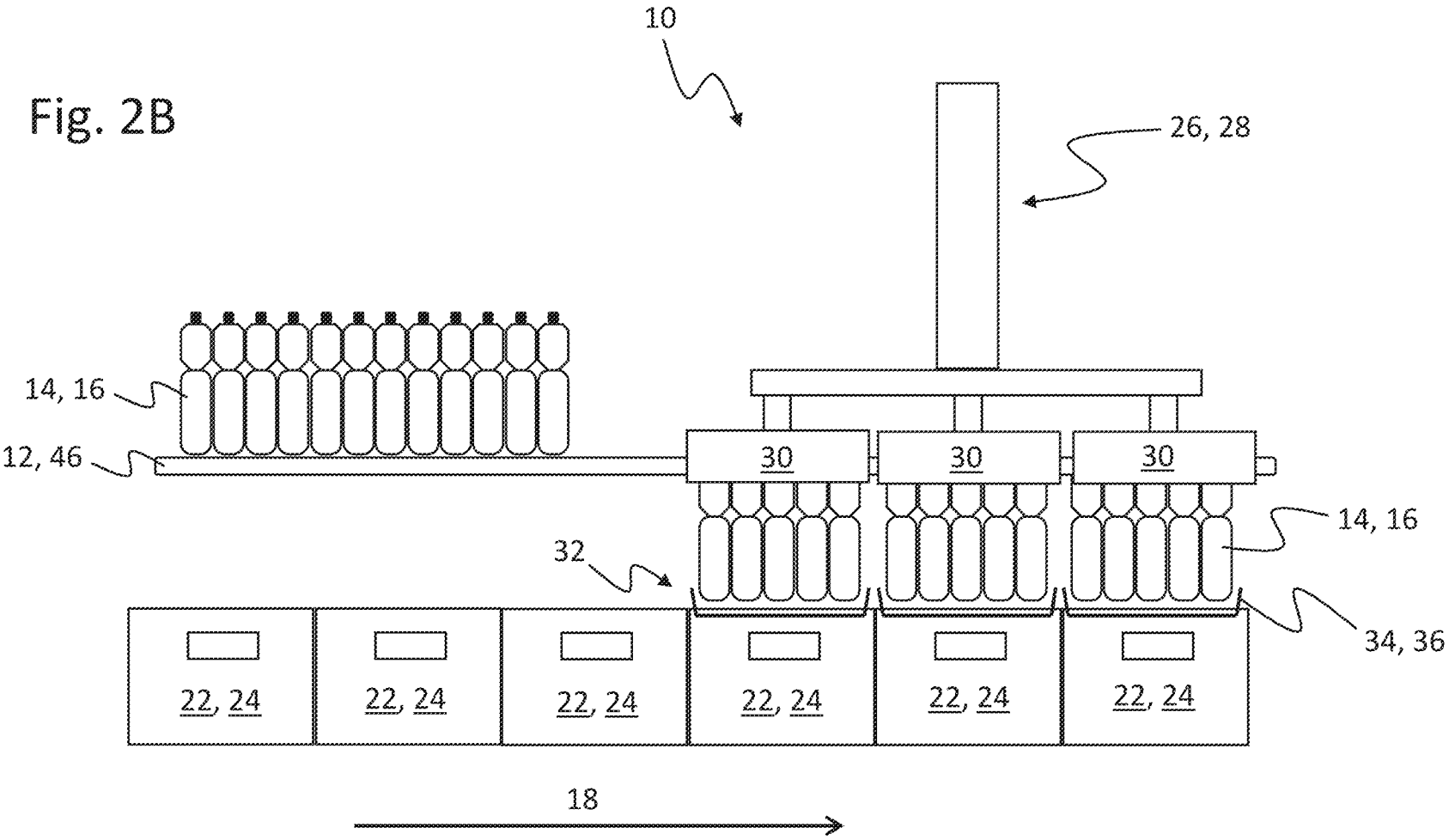

The schematic front view of the FIG. 2A and the schematic side view of the FIG. 2B illustrate the arrangement and mode of operation of the centering device 32, which forms an important component of the handling apparatus and/or packaging apparatus, and in which the centering elements 34 assigned to the individual outer packagings 22 or beverage crates 24 are in each instance formed by centering frames 36 in the exemplary embodiment shown here, which centering frames 36, at least during the phase of the outer packagings 22 or beverage crates 24 being loaded with articles 14 or beverage containers 16, are positioned above the particular beverage crate 24 and preferably placed on the top circumferential edge 38 of the particular beverage crate 24 (cf. FIG. 2A) or, where appropriate, are lowered by a short distance into it (cf. FIG. 2B).

As is indicated in FIG. 2A, the centering device 32 can be suspended from a gantry robot 40 or from a robot bridge, for example, and can in this manner be moved in different directions in order to ensure a precise positioning above the particular outer packagings 22 or beverage crates 24, which can be moved or can optionally be stopped on the second conveyor line 20 designed as horizontal conveying device 42 or as transport belt during the placing procedure, in order to be again conveyed further in transport direction 18 after having been loaded with the articles 14 or beverage containers 16.

An optional, continuous, individual centering of the individual centering frames 36 defines the position for the normally likewise robot-controlled gripper heads 30 of the handling device or, as applicable, of the manipulator 28. The typically robot-controlled gripper heads 30 can preferably coordinate or synchronize themselves with the continuous movements and positions of the centering elements or, as applicable, of the individual centering frames, whereby a precise and error-free placing movement can be ensured when lowering the articles 14 or beverage containers 16 to the particular target positions in the outer packagings 22 or beverage crates 24.

The FIGS. 2A and 2B furthermore show the first conveyor line 12 formed as container infeed 44, the first conveyor line 12 likewise being designed as horizontal conveying device. The beverage containers 16 or articles 14 are transported there in rows in conveying direction 18 to the staging location 46, where they are taken over groupwise by the gripper heads 30 of the manipulator 28 and conveyed in a transfer movement to the second conveyor line 20 with the outer packagings 22 or beverage crates 24 staged there. The beverage containers 16 being conveyed unspaced one after another in a plurality of rows to the staging location 46 can be row-wise separated from each other by so-called lane separators 48, for example. Optionally however, the containers 16 can also be conveyed in a mass flow as long as it is ensured that the gripper heads 30 can identify and seize the in each instance correct number of containers 16 in the mass flow.

Figure 2C:
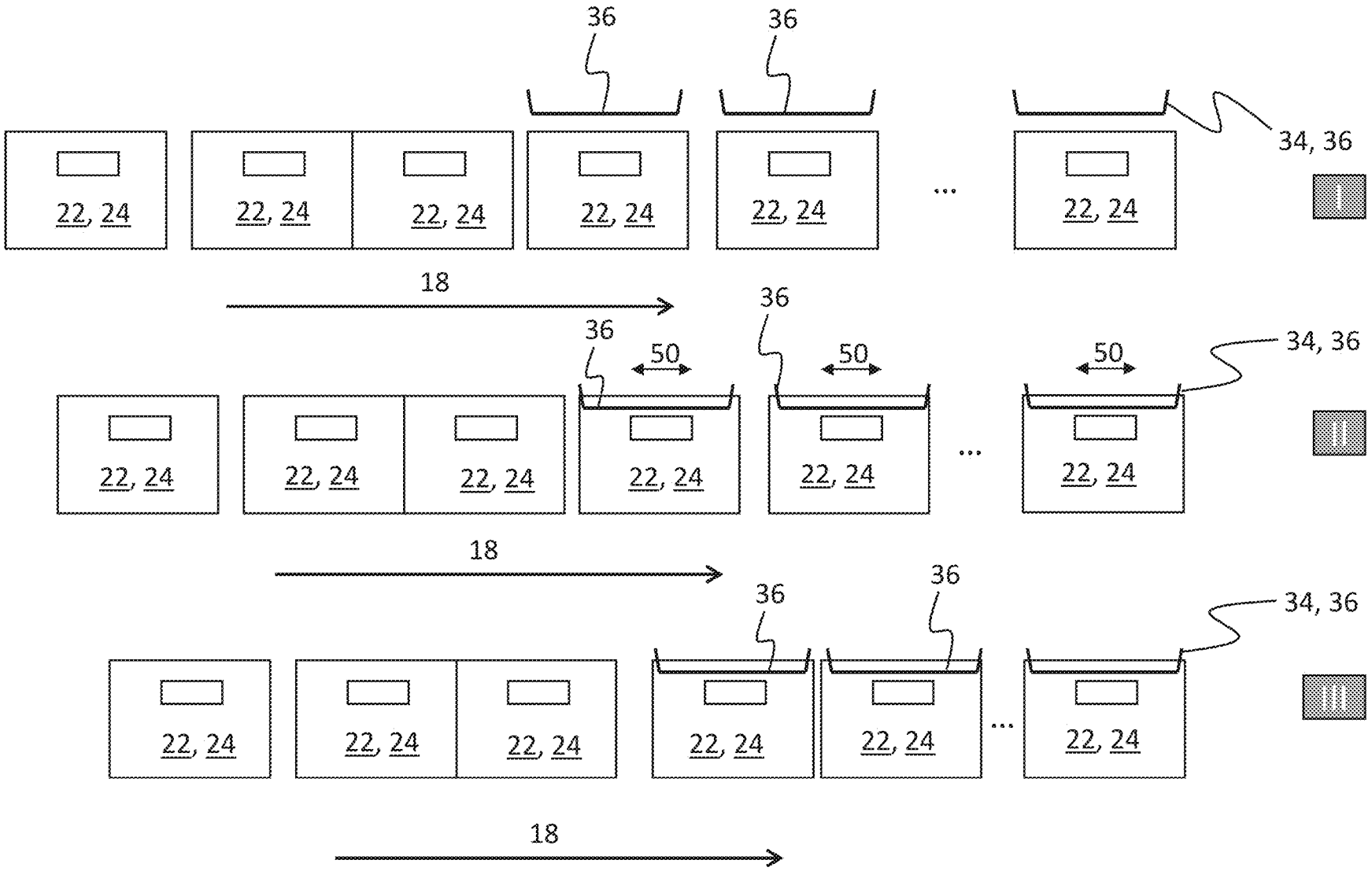

The schematic side views of FIG. 2B and FIG. 2C furthermore show the interaction of the centering frames 36 with the gripper heads 30, which have each seized a group of beverage containers 16 in order to lower and place them into the outer packagings 22 or beverage crates 24 that have been staged or that are being conveyed in transport direction 18.

As can be discerned from the schematic side view FIG. 2B, the centering frames 36 of the centering device 32 form not only an insertion aid for the precise positioning of the beverage containers 16 when lowering the particular gripper heads 30, but rather can the centering elements 32 also serve as effective centering aid in relation to the beverage crates 24 by being positioned and lowered inside the circumferential edge 38 of the particular crate 24. It is thereby possible to not only compensate for position deviations of the particular centered crate 24, but rather can the crate 24 in question also be prevented from assuming a deviating position in relation to the gripper head 30 or from evading the gripper head 30 in the lowering phase of the gripper head 30.

The schematic side view of the FIG. 2C illustrates the temporally consecutive phases of lowering the centering device 30 to above the outer packagings 22 formed by the beverage crates 24 in order to prepare and position these for being loaded with articles 14 or beverage containers 16. The top image I thus shows the approach of a plurality of centering frames 36 to outer packagings 22 in each instance being moved below thereto in conveying direction 18 and formed by beverage crates 24. In this context, the centering frames 36 are each positioned above the beverage crates 24 such that they can be subsequently lowered.

This phase of the centering procedure is shown below in the image II of FIG. 2C. The centering frames 36 are in this context located inside the circumferential edge 38 of the particular beverage crate 24 or are lowered into the crate 24, as applicable, whereby relative movements between centering frame 36 and crate 24 are largely excluded. The centering frames 36 in this context move in conveying direction 18 at the same conveying speed as the crates 24, that is, synchronously with the beverage crates 24. The horizontal directional arrows above the particular centering frames 36 are intended to illustrate the horizontal alignment 50 thereof in relation to the crate 24 assigned to each frame 36.

The bottom image III of the FIG. 2C illustrates the precisely aligned centering frames 36, which now not only enable the gripper heads 30 to be precisely positioned, as can be enabled optionally by an optical position detection and/or by a matching of the position data of the centering frames 36 and of the gripper heads 30. In addition, the centering frames 36 can by insertion aids, such as funnel-shaped guide plates, or guide panels, or the like that are not discernible here, provide for the precise positioning of the beverage containers (not shown here; cf., however, FIG. 2B) in the positions intended for them in the beverage crate 24, which can be, for example, separate target positions inside a partition in the beverage crate 24.

Figure 3A:
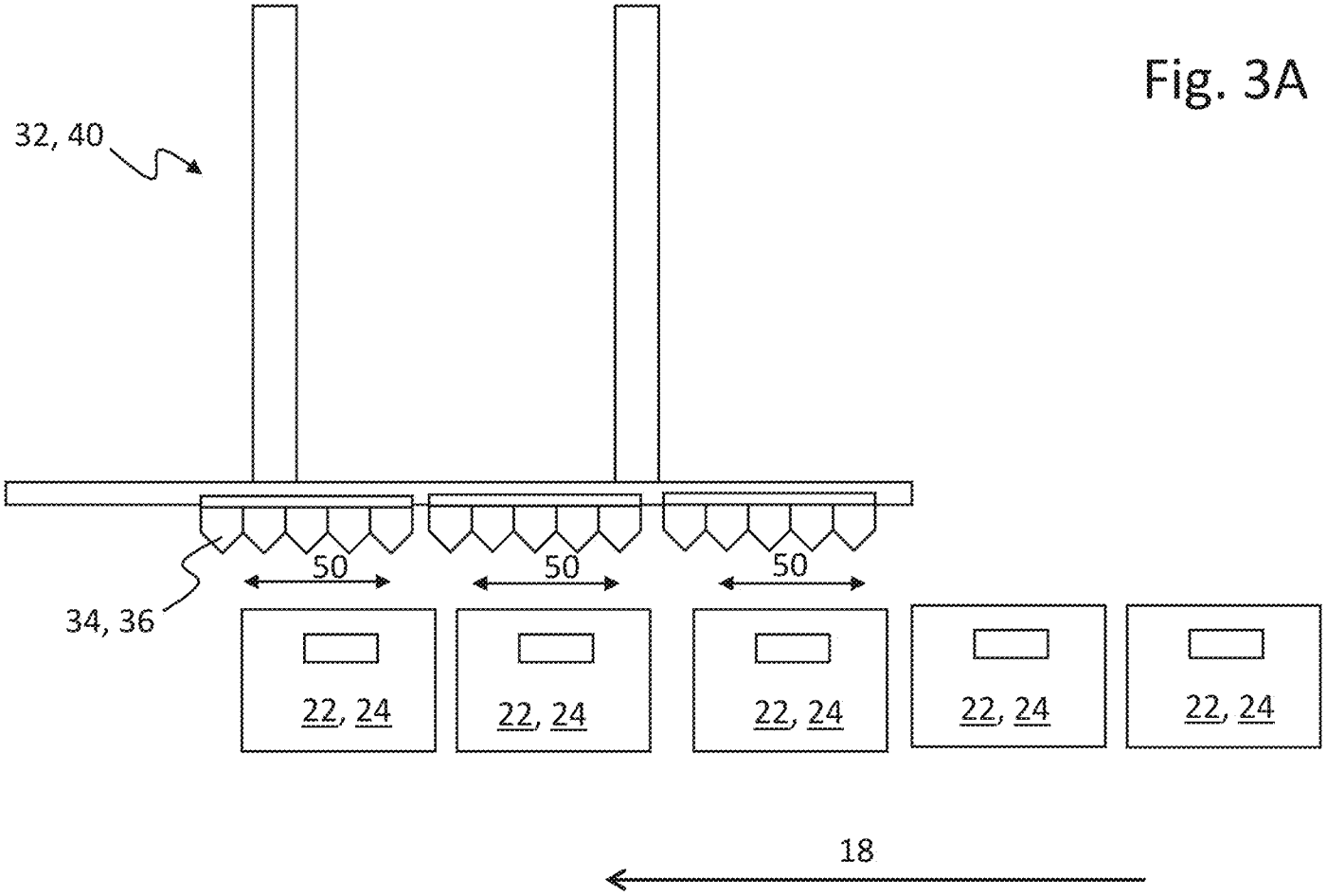
FIG. 3 shows consecutive process phases in a total of five schematic side views (FIGS. 3A to 3E) of a first embodiment variant of a centering device or, as applicable, of a first method variant of using the centering device in the loading of outer packagings with articles.

The altogether five schematic side views of FIGS. 3A to 3E illustrate consecutive process phases of a first embodiment variant of the centering device 32 or, as applicable, of a first method variant of using the centering device 32 in the loading of outer packagings 22 or beverage crates 24 with articles 14 or beverage containers 16. In this method variant, the control of the centering device 32 is carried out in such a manner that the centering elements 34 formed by the centering frames 36 can each be adjusted separately in horizontal direction, as is illustrated in FIG. 3A by the directional arrows identifying the particular horizontal alignment 50 of the centering elements 34 or centering frames 36 parallel to the conveying direction 18 of the outer packagings 22 or crates 24. The conveying direction 18 in these process phases in each instance points from right to left according to FIG. 3A, FIG. 3B, FIG. 3C, FIG. 3D, and FIG. 3E.

Figure 3B:
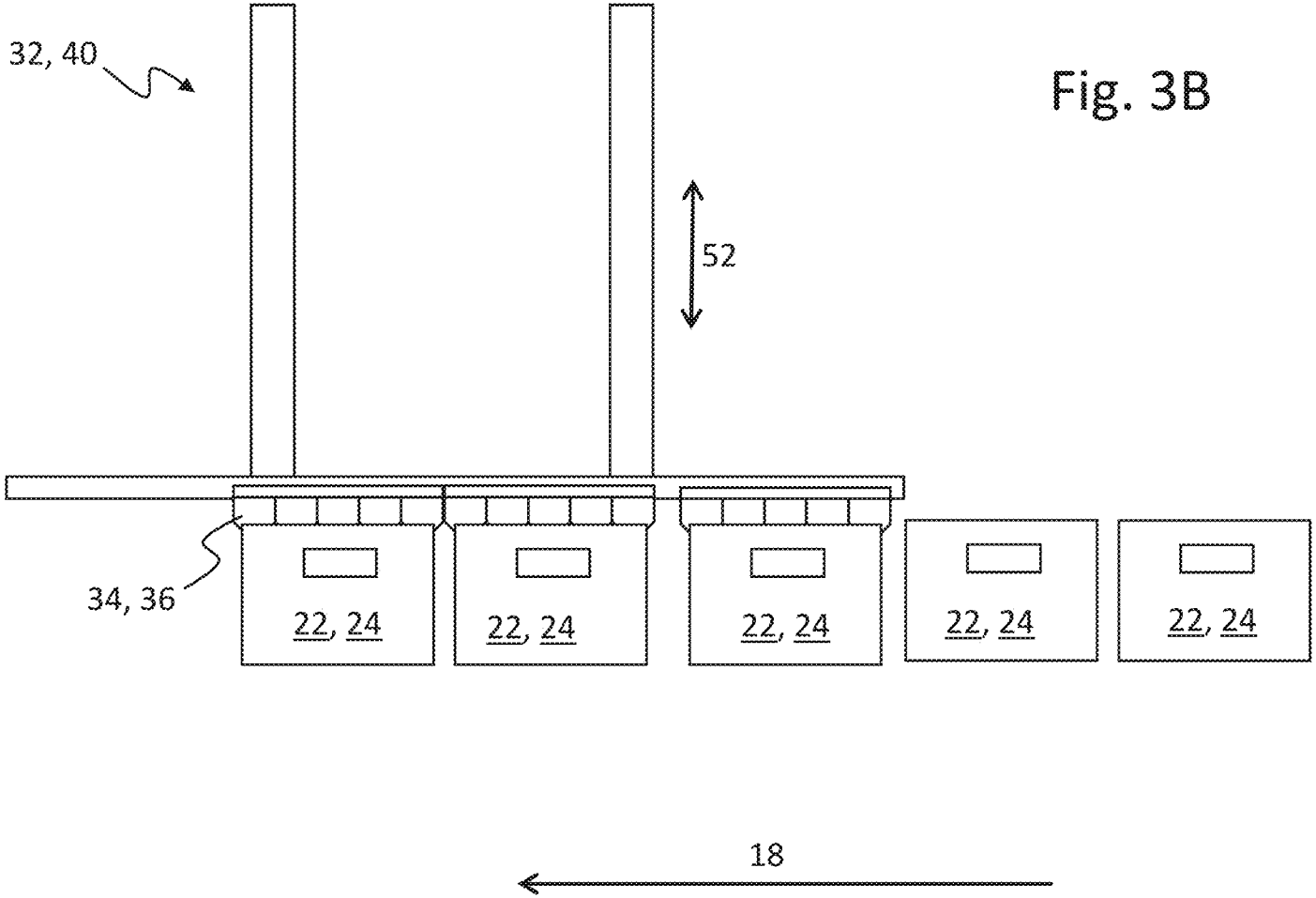

The centering device 32 in this variant is adjusted centrally in height under simultaneous adjustment of the centering elements 34 or centering frames 36, as is illustrated by the vertical double arrow in FIG. 3B indicating a vertical alignment 52. The entire centering device 32 can in this context be lifted and lowered by the gantry robot 40 shown in FIG. 2A.

The FIG. 3A illustrates the joint positioning of the centering frames 36 above the beverage crates 24 to be assigned to each, with the centering frames 36 being in each instance precisely positioned above the crates 24 by horizontal alignment 50 and being together moved along with the crates 24 in conveying direction 18 by a correspondingly synchronized movement. The FIG. 3B shows the centering frames 36 positioned in the crates 24 by the centering device 32 being correspondingly moved downward, in which context the centering device 32 together with the centering frames 36 are in turn moved further in conveying direction 18 along with the crates 24.

Figure 3C:
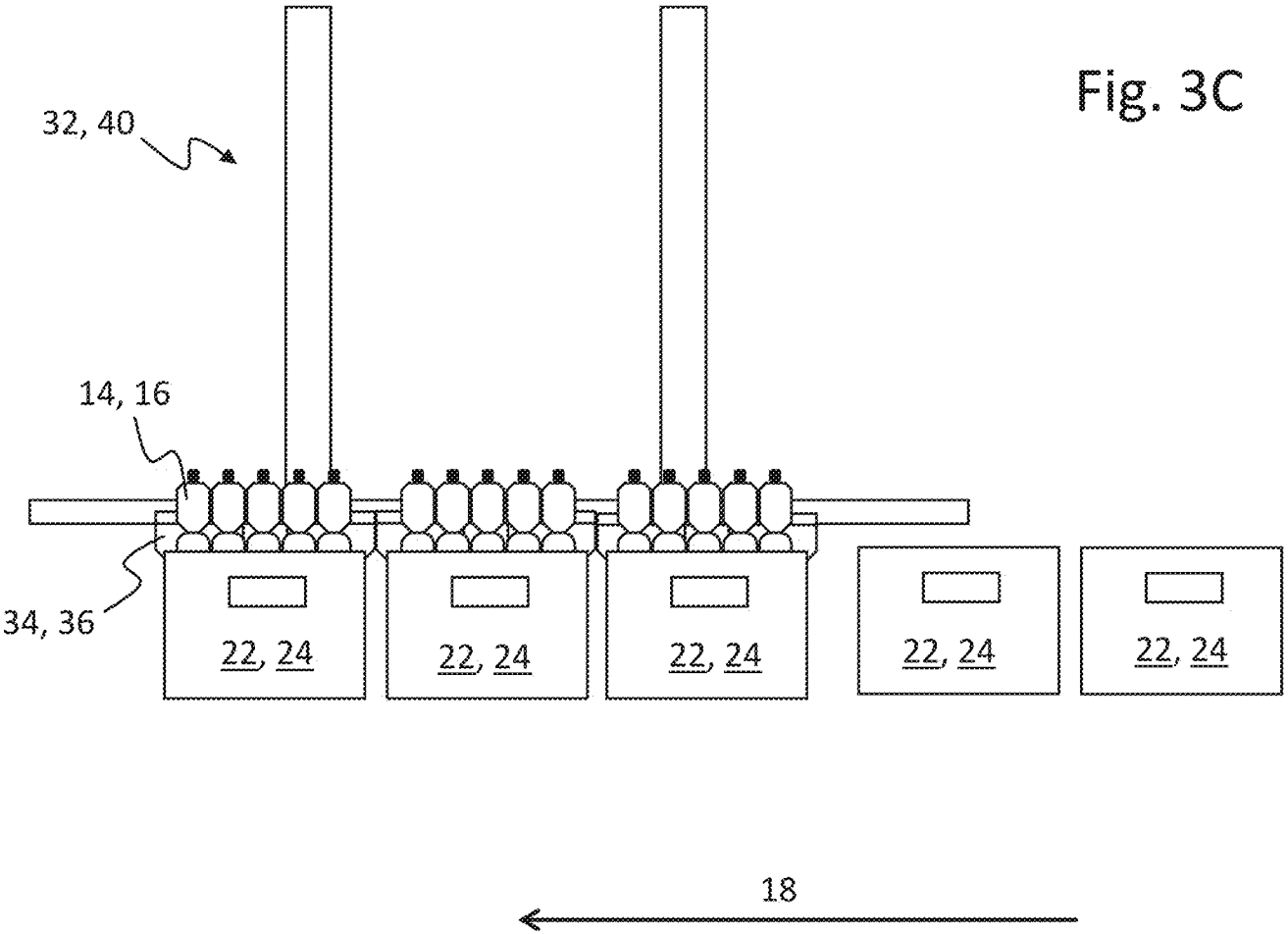
Figure 3D:
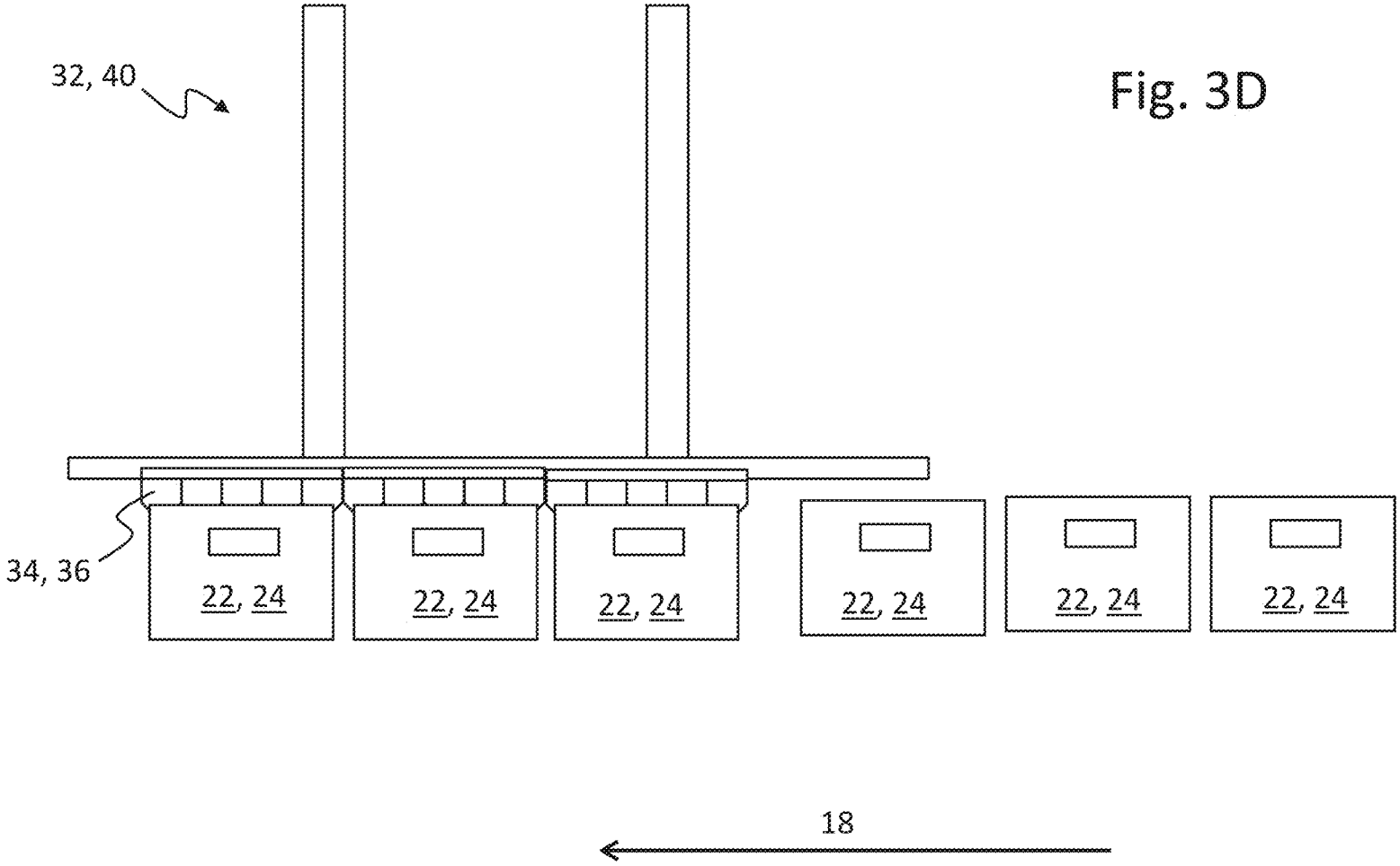
Figure 3E:
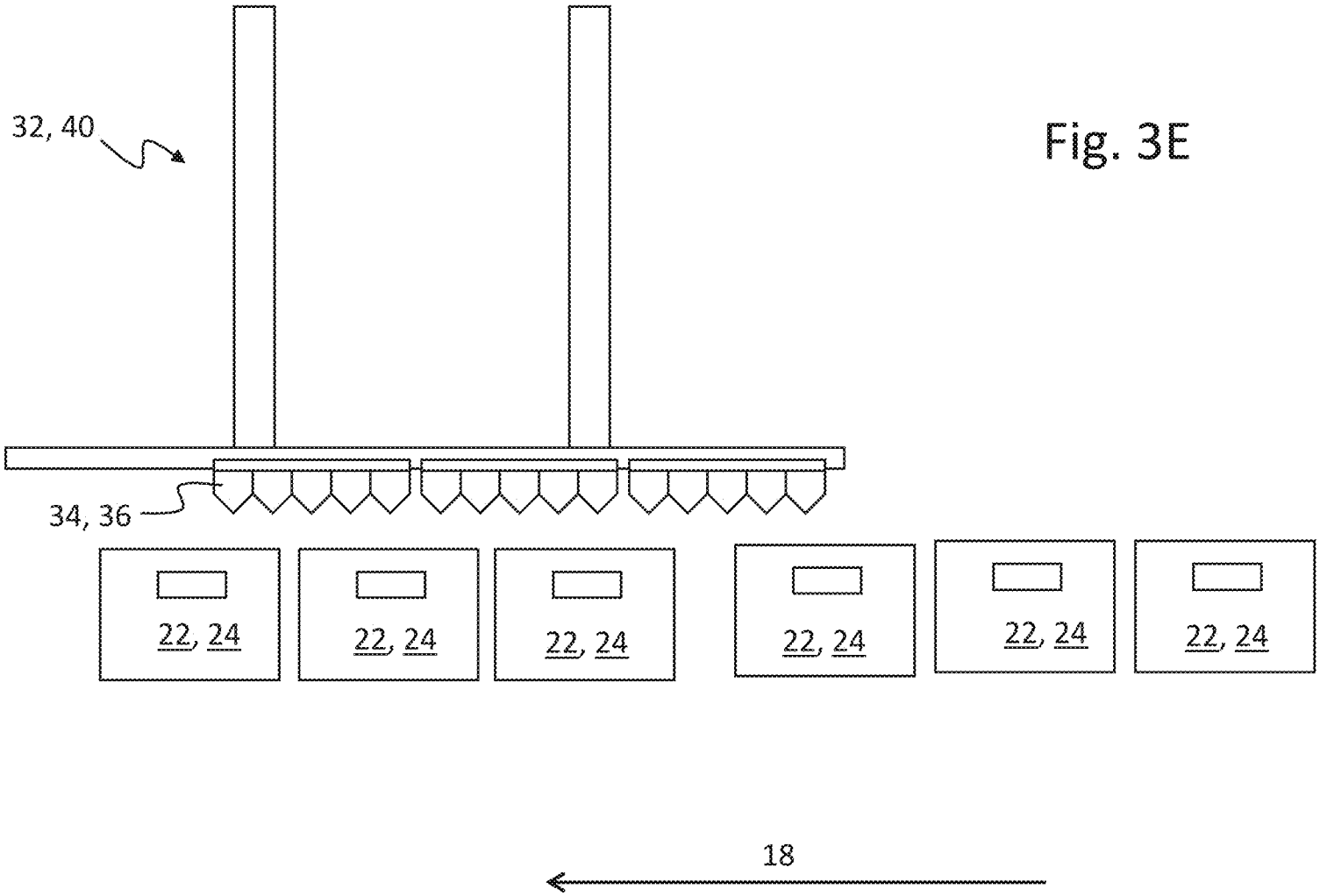

The FIG. 3C illustrates the loading procedure, in which the beverage containers 16 are placed into the beverage crates 24 as groups, in which context their collision-free lowering and their precise positioning inside the particular crate 24 is supported by the centering frames 36 in the above repeatedly described manner. The FIG. 3D shows a phase of the process, in which the beverage crates 24 completely loaded with beverage containers 16 are moved further in conveying direction 18, with the centering frames 36 still located in a lowered contact position on the crates 24. The FIG. 3E, finally, shows a concluding process phase, in which the centering device 32 is in a lifted position and the centering frames 36 are lifted out of the completely loaded crates 24 such that they can be placed on the following beverage crates 24 as soon as these, by being conveyed in conveying direction 18, have reached the position to be loaded with the beverage containers 16 provided for this purpose.

Figure 4A:
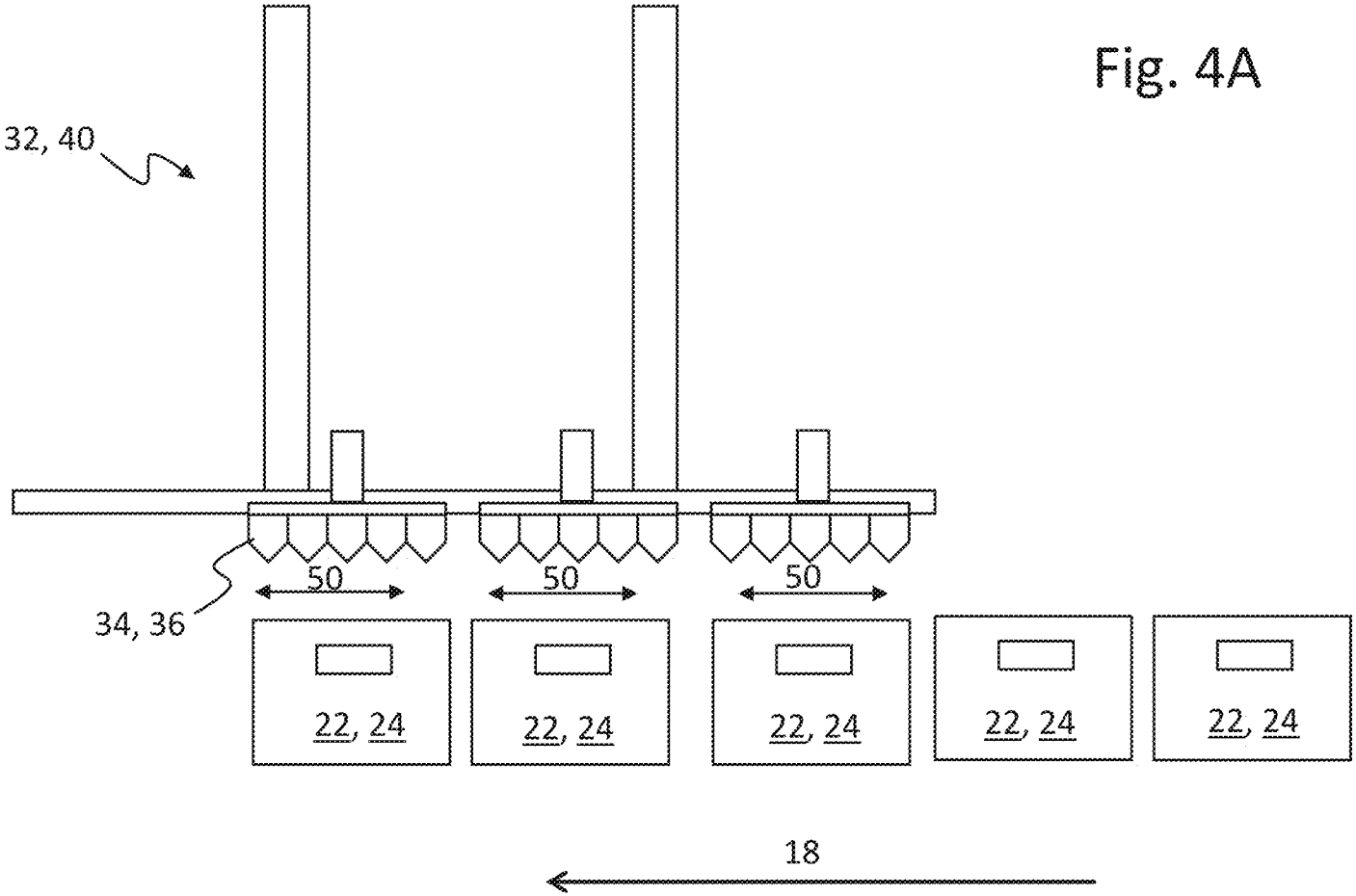
FIG. 4 shows consecutive process phases in a total of three schematic side views (FIGS. 4A to 4C) of a second embodiment variant of a centering device or, as applicable, of a second method variant of using the centering device in the loading of outer packagings with articles.
Figure 4B:
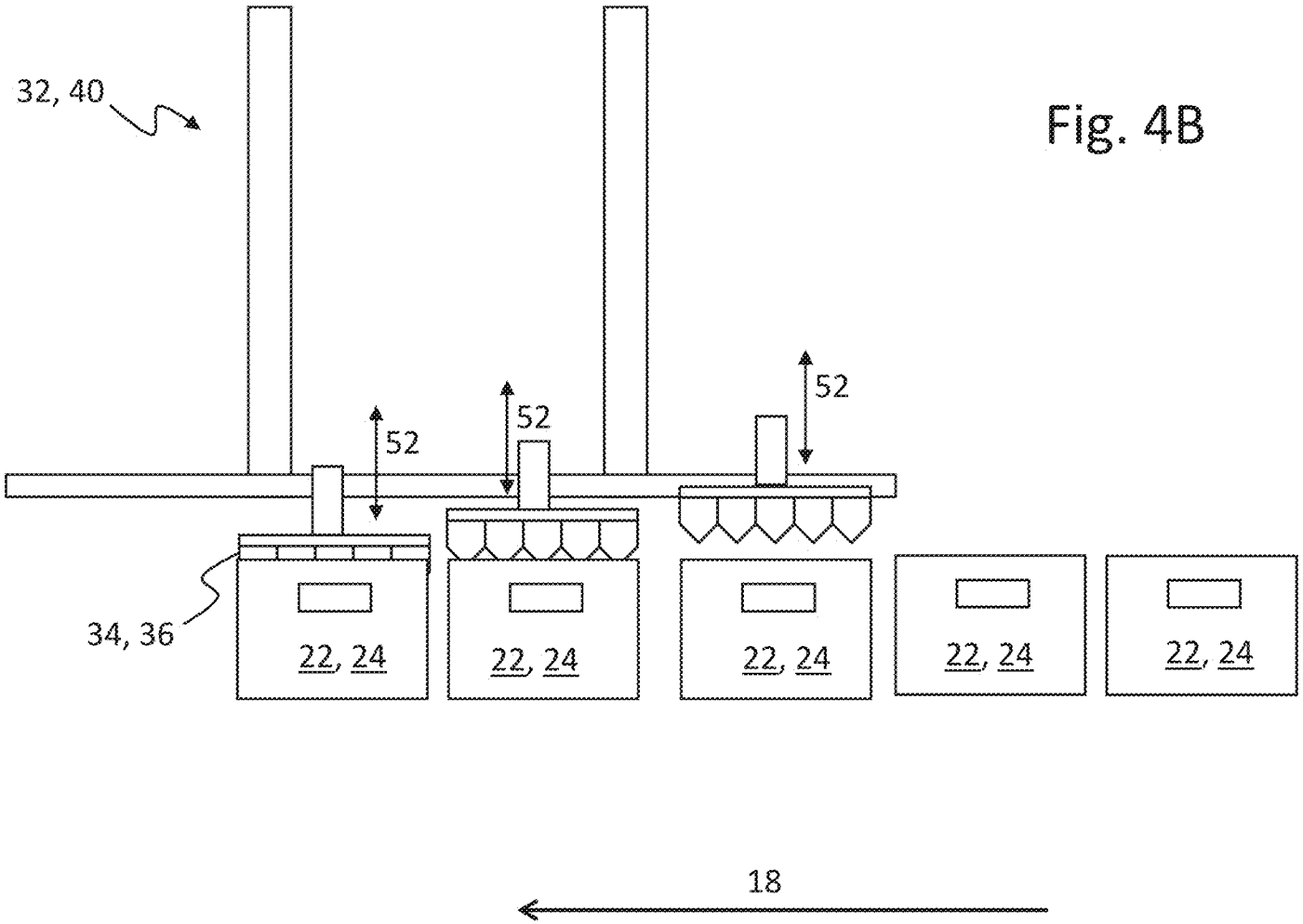
Figure 4C:
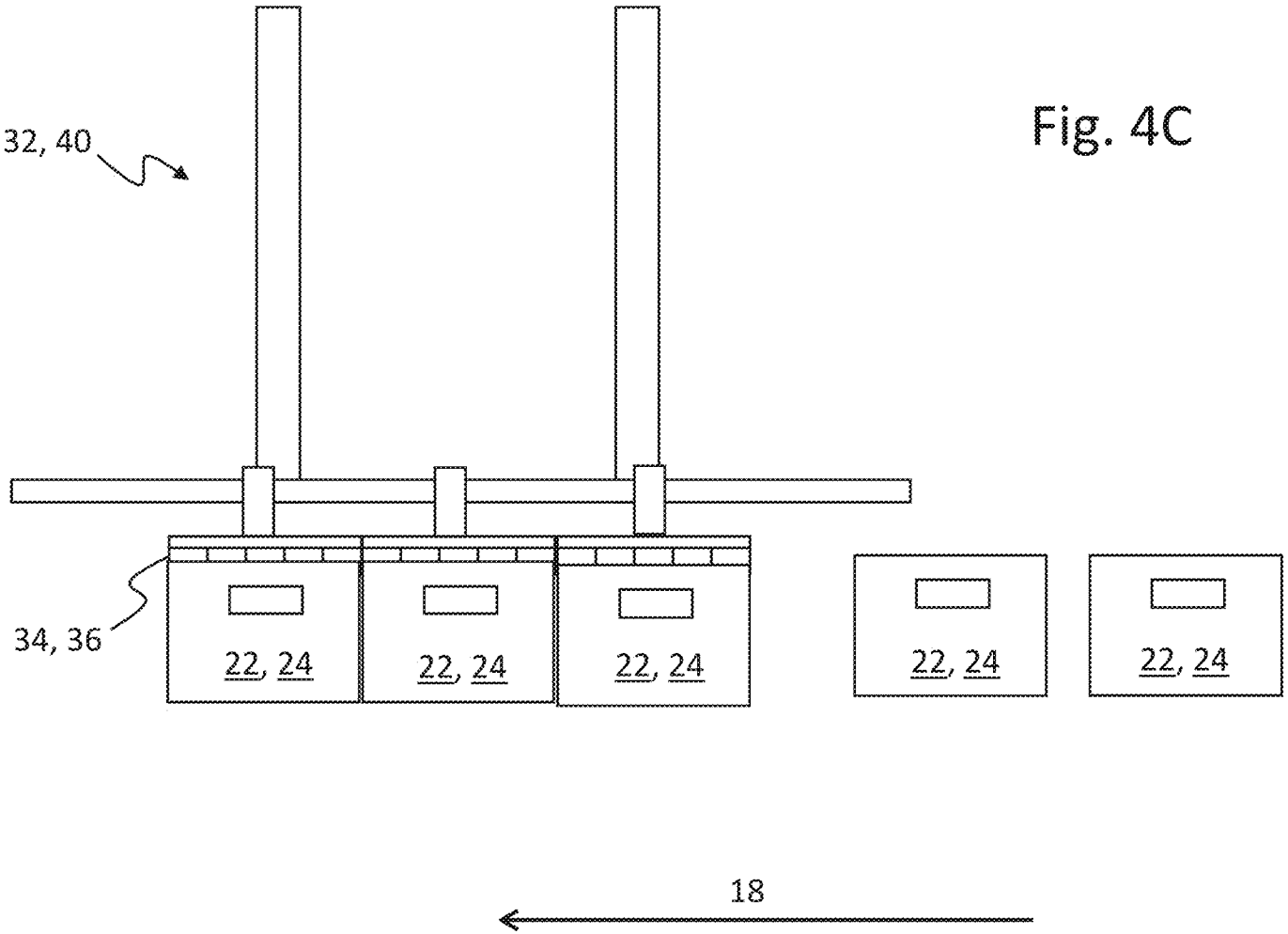

The altogether three schematic side views of FIGS. 4A to 4C illustrate consecutive process phases of a second embodiment variant of the centering device 32 or, as applicable, of a second method variant of using the centering device 32 in the loading of outer packagings 22 or beverage crates 24 with articles 14 or beverage containers 16.

In this second method variant, the control of the centering device 32 is again carried out in such a manner that the centering elements 34 formed by the centering frames 36 can each be adjusted separately in horizontal direction, as is illustrated in FIG. 4A by the directional arrows identifying the particular horizontal alignment 50 of the centering elements 34 or centering frames 36 parallel to the conveying direction 18 of the outer packagings 22 or crates 24. Again, the conveying direction 18 in these process phases in each instance points from right to left according to FIG. 4A, FIG. 4B, FIG. 4C.

Although the centering device 32 in this second method variant is again centrally adjusted in height, the centering elements 34 or centering frames 36 suspended from the gantry robot 40 can in this instance each be adjusted in height in relation to the centering device 32 separately and independently of one another, as is illustrated by the three vertical double arrows in FIG. 4B each indicating a vertical alignment 52 of the centering frames 36.

While in this context the entire centering device 32 can also be lifted and lowered by the gantry robot 40 shown in FIG. 2A, the separately height-adjustable centering frames 36 enable an improvement of the synchronization of the crate movements with the frame movements, because the individual centering frames 36 are pre-positioned and can be lowered to above the appropriate beverage crate 24 immediately after reaching their particular target position, in which context, moreover, the loading procedure by positioning and lowering of the appropriate gripper head (not illustrated here) can already start without already having to load the adjacent crates 24. This option, however, requires a correspondingly designed suspension of the manipulator 28, which has to enable an independent control of the gripper heads 30.

The FIG. 4A illustrates the joint positioning of the centering frames 36 above the beverage crates 24 to be assigned to each, with the centering frames 36 being in each instance precisely positioned above the crates 24 by horizontal alignment 50 and being together moved along with the crates 24 in conveying direction 18 by a correspondingly synchronized movement. The FIG. 4B shows the centering frames 36 of the centering device 32 being successively moved downward such that the left centering frame 36 is already positioned in the beverage crate 24 while the middle centering frame 36 is still being lowered and the right centering frame 36 is still located spaced apart above the crate 24 assigned to it. In these process phases, the centering device 32 together with the centering frames 36 are again moved further in conveying direction 18 with the crates 24.

The actual loading procedure is not shown in the FIGS. 4A to 4C; for this purpose, it is referred to FIG. 3C, for example. The FIG. 4C shows a phase of the process in which the beverage crates 24 completely loaded with beverage containers 16 are moved further in conveying direction 18, with the centering frames 36 still located in a lowered contact position on the crates 24. The final process phase, in which the centering device 32 is in a lifted position and the centering frames 36 are lifted out of the completely loaded crates 24, is in turn not shown (cf. FIG. 3E for this purpose).

Figure 5A:
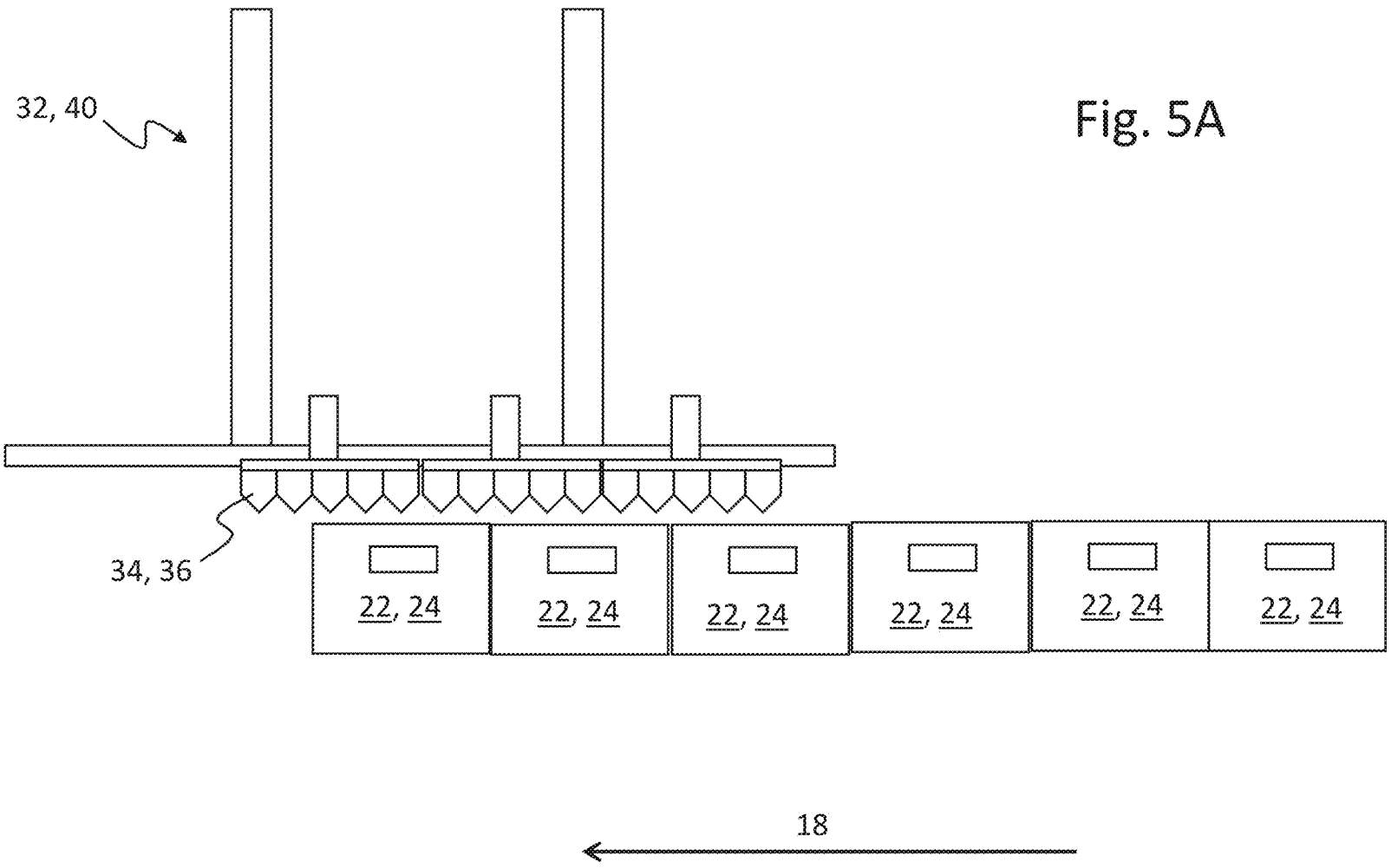
FIG. 5 shows consecutive process phases in a total of three schematic side views (FIGS. 5A to 5C) of a third embodiment variant of a centering device or, as applicable, of a third method variant of using the centering device in the loading of outer packagings with articles.
Figure 5B:
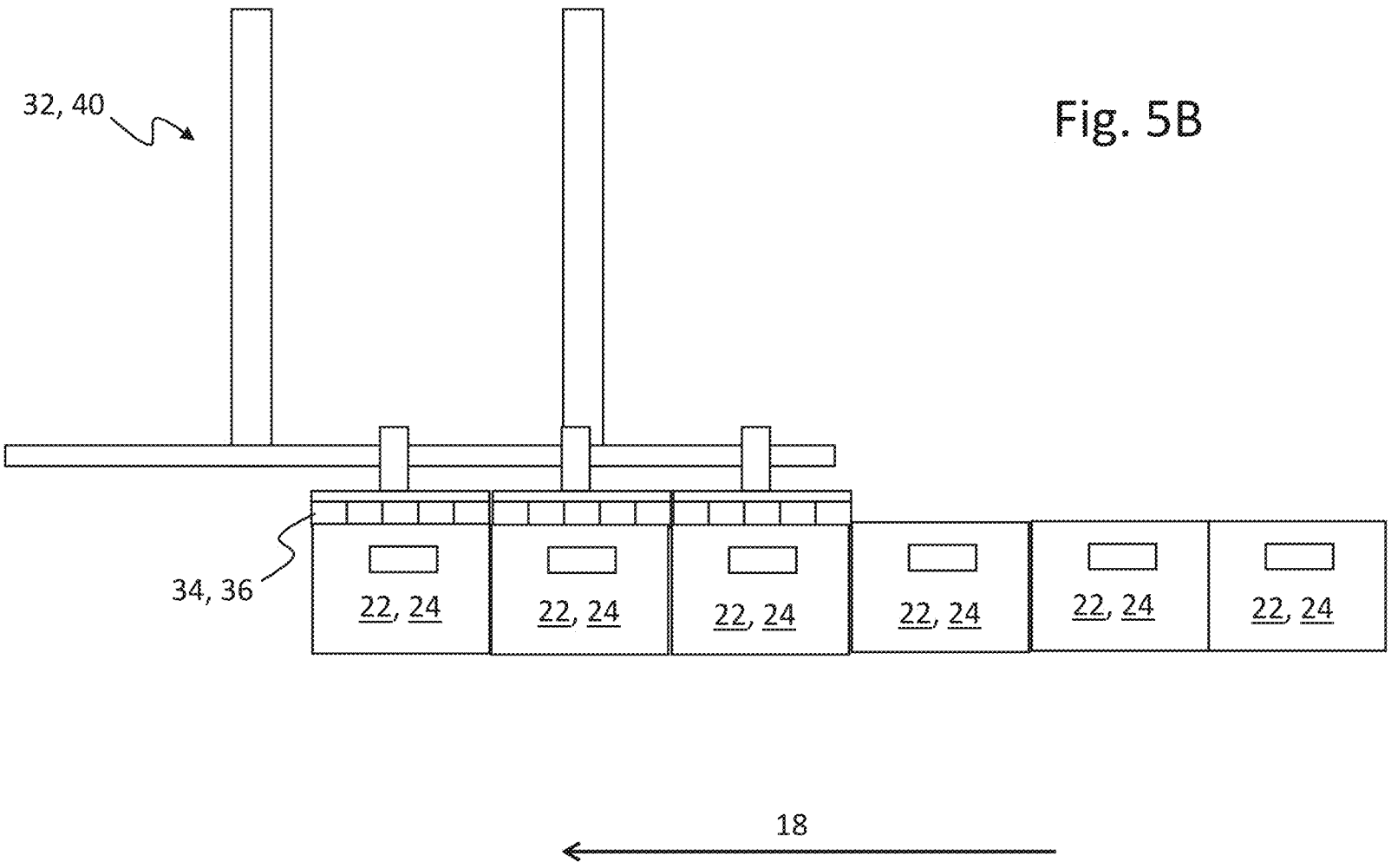
Figure 5C:
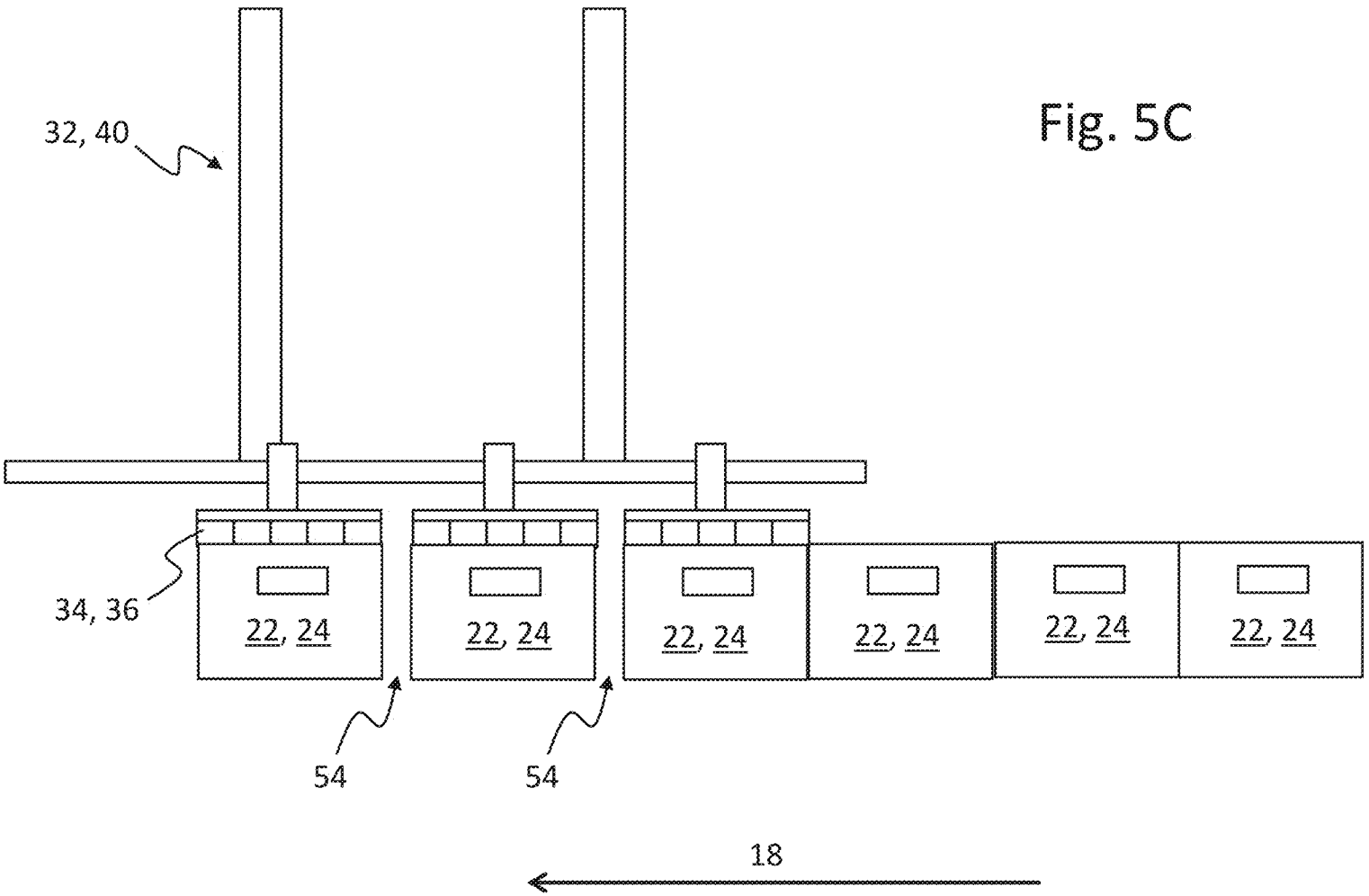

The altogether three schematic side views of FIGS. 5A to 5C illustrate consecutive process phases of a third embodiment variant of the centering device 32 or, as applicable, of a third method variant of using the centering device 32 in the loading of outer packagings 22 or beverage crates 24 with articles 14 or beverage containers 16.

In this third method variant, the control of the centering device 32 is carried out as in the first variant according to FIG. 3A to FIG. 3E in such a manner that the centering elements 34 formed by the centering frames 36 can each be adjusted separately in horizontal direction, in which context the conveying direction 18 in these process phases in each instance again points from right to left according to FIG. 5A, FIG. 5B, and FIG. 5C.

The centering device 32 in this third method variant is adjusted centrally in height and can be lifted and lowered by the gantry robot 40 shown in FIG. 2A. However, the in horizontal direction separately height-adjustable centering frames 36 enable the beverage crates 24 to be spaced apart in a in a specified manner as soon as the centering frames 36 are positioned and lowered there, as is clearly demonstrated in the FIG. 5C.

The FIG. 5A illustrates the joint approaching and positioning of the centering frames 36 above the beverage crates 24 to be assigned to each, with the centering frames 36 being in each instance precisely positioned above the unspaced, consecutively conveyed crates 24 by horizontal alignment 50 and being together moved along with the crates 24 in conveying direction 18 by a correspondingly synchronized movement. The FIG. 5B shows the centering frames 36 that have been lowered into the crates 24. In these process phases, the centering device 32 together with the centering frames 36 are again moved further in conveying direction 18 with the crates 24.

The FIG. 5C illustrates a phase in which the adjacent crates 24, into which the centering frames 36 have in each instance been lowered, are spaced apart from one another in a specified manner, which can be advantageous, in particular, for the following positioning of the gripper heads of the manipulator, if the gripper heads require more distance from one another due to their lateral extension than is possible with crates 24 that are pushed together according to FIG. 5B in an immediately adjacent manner. The beverage crates 24 to be loaded with beverage containers can in this instance have definable spacings 54 from each other, and these spacings 54 can be variable by the adjustable horizontal alignments 50 of the centering frames 36.

The actual loading procedure is not shown in the FIGS. 5A to 5C; for this purpose, it is referred to FIG. 3C, for example. The FIG. 5C shows a phase of the process, in which the beverage crates 24 still to be loaded or already completely loaded with beverage containers 16 are moved further in conveying direction 18 with adjusted spacings 54 from one another, with the centering frames 36 in each instance being located in a lowered contact position on the crates 24. The final process phase, in which the centering device 32 is in a lifted position and the centering frames 36 are lifted out of the completely loaded crates 24, is in turn not shown (cf. FIG. 3E for this purpose).

Figure 6:
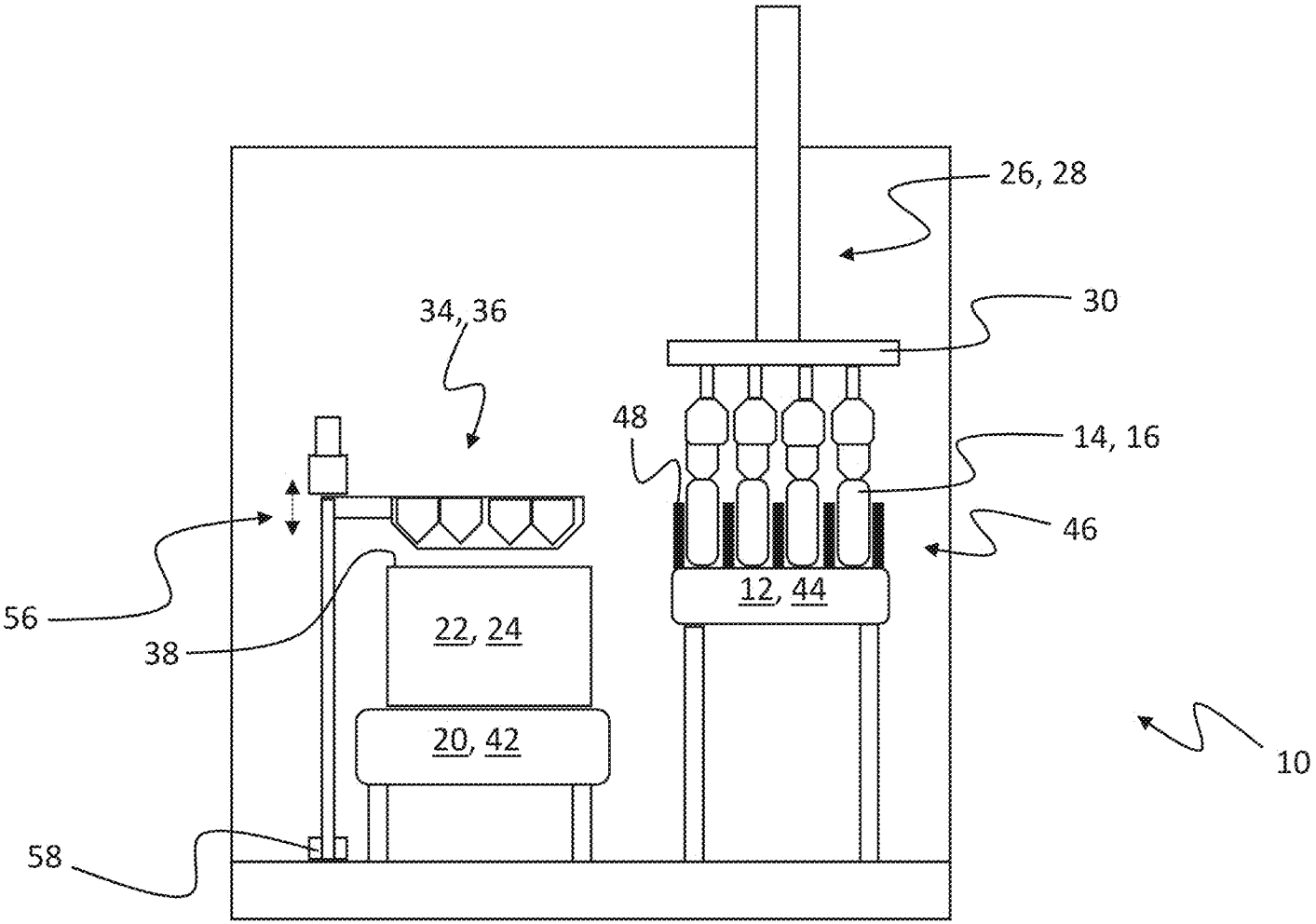
FIG. 6 shows a further variant of the handling apparatus and/or packaging apparatus in a schematic view.

The schematic front view of FIG. 6 illustrates an alternative embodiment variant to the variant shown in FIG. 2A of the suspension and control for the centering device 32, which is not suspended from a gantry robot 40 here, but rather comprises a simple rack 56, which can be slidable in a bottom rail 58 parallel to a horizontal conveying device 42 of the second conveyor line 20. In this manner, it is possible to move the rack 56, together with the centering frames 36 suspended therefrom and vertically movable at the rack 56, in conveying direction 18 or opposite to the conveying direction 18 along the conveyor line 20. This embodiment variant can be constructed in a simpler manner than the variant shown in FIG. 2A, because the gantry robot 40 for the movements of the centering device 32 is dispensed with. The remaining structure of the handling apparatus and/or packaging apparatus 10, however, does not differ from the variant shown in FIG. 2A.

A further movement component of the centering frame 36 transverse to the conveying direction 18 can additionally be possible in all shown variants in order to be able to compensate for skew positions and lateral offset of the outer packagings 22 or beverage crates 24. In this manner it is possible to load without problems outer packagings 22 or crates 24, for example, even if they are not aligned precisely in conveying direction 18, by correspondingly laterally shifted centering elements 34 or centering frames 36, in which instance it can be additionally provided that the lowered centering frames 36 can bring the crates 24 precisely in alignment with each other by being shifted in horizontal direction transverse to the conveying direction 18 until all crates 24 or outer packagings 22 in contact with the centering device 32 are in alignment with each other.

The invention has been described with reference to a preferred embodiment. Those skilled in the art will appreciate that numerous changes and modifications can be made to the preferred embodiments of the invention and that such changes and modifications can be made without departing from the spirit of the invention. It is therefore intended that the appended claims cover all such equivalent variations as fall within the true spirit and scope of the invention.

LIST OF REFERENCE CHARACTERS

10 Handling apparatus, packaging apparatus, handling apparatus and/or packaging apparatus
12 First conveyor line
14 Article
16 Beverage container
18 Conveying direction, transport direction
20 Second conveyor line
22 Outer packaging
24 Beverage crate, beverage case, case
26 Handling station, handling device, handling station and/or packaging station
28 Manipulator
30 Gripper head
32 Centering device
34 Centering element
36 Centering frame
38 Edge, circumferential edge
40 Robot, gantry robot
42 Conveying device, horizontal conveying device
44 Infeed, container infeed
46 Staging location
48 Lane separator
50 Horizontal alignment (centering frame)
52 Vertical alignment (centering frame, centering device)
54 Spacing
56 Rack
58 Bottom rail

The invention claimed is:

1. A handling apparatus or packaging apparatus (10) used to package article groups in outer packaging or to place article groups into outer packagings (22), comprising:

a staging location (46) for a plurality of articles (14) in at least one article group;

at least one conveyor line (20) used to successively transport outer packagings (22);

at least one handling device (26) that is movable between the staging location (46) and the at least one conveyor line (20), the handling device (26) capable of simultaneously receiving and seizing at least one article group from the staging location (46), transferring the at least one article group to the conveyor line (20), and placing the at least one article group into one of the outer packagings (22), wherein the handling device (26) comprises at least one controllable gripper head (30) with gripping elements that are controllable: a) individually or individually in groups and b) independently from the gripper head (30); and a centering device (32) assigned to the at least one conveyor line (20) and movable along with the outer packagings (22), the centering device (32) capable of directing or guiding at least one of the plurality of articles (14) of a particular article group into the outer packagings (22).

2. The apparatus of claim 1, wherein each of the outer packagings (22) to be loaded has a separate centering element (34) assigned to it, wherein each centering element (34) is a component of the centering device (32).

3. The apparatus of claim 2, wherein each centering element (34) comprises a centering frame (36), wherein the size of the centering frame (36) corresponds to a base area of the outer packagings (22), and wherein the centering frame (36) can be positioned above or placed on a circumferential edge (38) of each of the outer packagings (22).

4. The apparatus of claim 3, wherein the centering frame (36) has a plurality of directing devices to direct the articles (14) comprise guide panels leading into the outer packaging (22).

5. The apparatus of claim 3, wherein a plurality of centering elements (34) disposed next to each other form the centering device (32).

6. The apparatus of claim 1, wherein the centering device (32) is guided by a movable robot arm (40).

7. The apparatus of claim 1, wherein the centering device (32) is guided by a gantry suspension disposed slidably on a rail (58) along the conveyor line (20).

8. The apparatus of claim 1, wherein the centering device (32) is controllable in its movements based on the detected movements of the outer packagings (22) or based on an evaluation of the sensor signals supplied by at least one optical sensor detecting the outer packagings (22).

9. A method used to package article groups in outer packagings or to place article groups into outer packagings (22), comprising:

transferring a plurality of articles (14) in at least one article group by a handling device (22) from a staging location (46) for the article groups to at least one conveyor line (20) used to successively transport outer packagings (22), wherein the handling device (26) comprises at least one controllable gripper head (30) with gripping elements that are controllable: a) individually or individually in groups and b) independently from the gripper head (30), and placing the transferred article groups into the outer packagings (22), wherein the placing step comprises directing or guiding at least one of the articles (14) of a particular article group into the outer packagings (22) by a centering device (32) assigned to the at least one conveyor line (20) and moved along with the outer packagings (22).

10. The method of claim 9, wherein each outer packaging (22) to be loaded by a gripper head (30) of the handling device (26) has a separate centering element (34) assigned to it, which centering element (34) is part of the movable centering device (32).

11. The method of claim 10, further comprising coordinating or synchronizing positioning movements of the at least one gripper head (30) with positioning movements of the at least one centering element (34) of the centering device (32).

12. The method of claim 10, further comprising adjusting the centering elements (34) together or separately in vertical direction in order to be positioned on or above the outer packagings (22).

13. The method of claim 10, further comprising adjusting the centering elements (34) together or separately in transport direction (18) or opposite to the transport direction (18) in order to be positioned on or above the outer packagings (22).

14. The method of claim 10, further comprising adjusting the centering elements (34) together or separately transverse to the transport direction (18) in order to be positioned on or above the outer packagings (22).

15. The method of claim 9, wherein the centering device (32), with at least one centering element (34), is controlled in its movements based on the detected movements of the outer packagings (22) or based on an evaluation of the sensor signals supplied by at least one optical sensor detecting the outer packagings (22).

* * * * *